US008420917B1

(12) United States Patent
Yokozeki et al.

(10) Patent No.: US 8,420,917 B1
(45) Date of Patent: Apr. 16, 2013

(54) MUSICAL INSTRUMENT

(75) Inventors: Atsushi Yokozeki, Shizuoka (JP); Takahiro Murai, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 13/544,997

(22) Filed: Jul. 10, 2012

(30) Foreign Application Priority Data

Nov. 2, 2011 (JP) ..... 2011-241700

(51) Int. Cl.
*G10C 1/00* (2006.01)

(52) U.S. Cl.
USPC ..... 84/174

(58) Field of Classification Search ..... 84/423 R, 84/438, 448, 2, 7, 13, 173, 174, 177–179
See application file for complete search history.

(56) References Cited

U.S. PATENT DOCUMENTS 2,505,805 A * 5/1950 Stein ..... 84/174
6,469,237 B1 * 10/2002 Arimori ..... 84/174
7,696,428 B2 * 4/2010 Konishi ..... 84/719

FOREIGN PATENT DOCUMENTS

JP H09-160560 6/1997

* cited by examiner

*Primary Examiner* — Kimberly Lockett
(74) *Attorney, Agent, or Firm* — Jianq Chyun IP Office

(57) ABSTRACT

A musical instrument is provided. When the lid is revolved in a direction to open the lid from a close state of the lid, the guided part is guided to an inner peripheral concave surface of the guiding channel and is engaged with the inner peripheral concave surface. The lid is supported by the bearing bar 30, and the lid is maintained being up. After the lid is revolved in a direction to further open the lid from the open state and the guided part is disengaged from the inner peripheral concave surface, the lid can be laid down by revolving in a direction for laying down the lid. Therefore, the lid can be changed to an open state or a close state by only revolving the lid.

14 Claims, 16 Drawing Sheets

MUSICAL INSTRUMENT

CROSS-REFERENCE TO RELATED APPLICATION

This application claims the priority benefit of Japan application serial no. 2011-241700, filed on Nov. 2, 2011. The entirety of the above-mentioned patent application is hereby incorporated by reference herein and made a part of this specification.

TECHNICAL FIELD

The present invention relates to a musical instrument. Particularly, the present invention relates to a musical instrument which can simplify an operation for adjusting a revolving board from a closed state to an open state.

BACKGROUND

A keyboard instrument with a top board which can open/close an upper opening has long been known. When a user plays the keyboard instrument, an expansion of sound and a sound quality, etc., during performance can be improved by opening the top board.

For example, Patent No. H09-160560 Gazette disclosed a technology to maintain a state in which the top board is opened by supporting the top board (revolving board) with a prop (bearing bar) located around the upper opening of the keyboard instrument, and close the top board by removing the support of the top board by the prop.

However, in the conventional keyboard instrument mentioned above, when the top board maintains the opening state, opening the top board is required by one hand while operating the prop by the other hand for the prop to support the top board.

Therefore, having to operate two members simultaneously and separately with both hands when the top board is opened is problematic and complicated. In addition, in this case, if the top board is slipped from one hand while the prop is operated by the other hand, there is a risk of pinching the other hand between the top board of the keyboard instrument and the top board.

SUMMARY

A purpose of the present invention for solving the above-mentioned problem is to provide a musical instrument which can simplify an operation for adjusting a revolving board from a close state to an open state.

According to one aspect of the present invention, a musical instrument is provided. The musical instrument comprises a revolving board, a bearing bar and a guiding member. The revolving board is supported on a musical instrument body in a rotatable manner rotating about a first axis and is switched between a close state and an open state. One end of the bearing bar is supported on the revolving board in a rotatable manner rotating about a second axis, and the other end of the bearing bar is guided to a guiding channel of the guiding member.

The guiding channel includes an inner peripheral wall forming an inner peripheral of the guiding channel. In a close state of the revolving board, the other end of the bearing bar is located on a vertical line passing through a second axis, and a guiding inclined plane of the inner peripheral wall is located above the other end of the bearing bar. Moreover, the guiding inclined plane is configured to incline upward while the other end of the bearing bar moves away from the first axis. Accordingly, when the revolving board is revolved to a direction to be opened (that is, upward and in a direction close to the first axis) from a state in which the revolving board is closed and the other end of the bearing bar is located on the vertical line passing through the second axis, the other end of the bearing bar abuts on the guiding inclined plane to be guided upward and in a direction away from the first axis. Accordingly, the guidance of the other end of the bearing bar is completed by the guiding inclined plane, and the other end of the bearing bar is forced to return to the vertical line of the second axis. Thereby the other end of the bearing bar moves to a side close to the first axis, and the other end of the bearing bar can be smoothly guided to the loop-shaped guiding channel.

In addition, the other end of the bearing bar is guided to a first concave surface located above the guiding inclined plane by moving toward a side close to the first axis passing over the guiding inclined plane. The first concave surface is recessed downward; therefore, the other end of the bearing bar is engaged with the first concave surface, and the movement in a direction close to or away from the first axis of the other end of the bearing bar is restrained. As a result, the revolving board is supported by the bearing bar in an open state so that the revolving board can maintain the open state.

Accordingly, since the revolving board can be changed from the close state to the open state by performing only the revolving operation of the revolving board, the operation of adjusting the revolving board from the close state to the open state can be simplified. In addition, as a result, since it is not necessary to operate the revolving board with one hand while operating the bearing bar with the other hand when the revolving board is changed from the laying-down state to the open state, the risk of pinching the other hand between the revolving board and the musical instrument body can be prevented.

According to other aspect of the present invention, the other end of the bearing bar is engaged with the first concave surface at a position which is further away from the first axis than the vertical line passing through the second axis in the open state of the revolving board; therefore, the revolving board can be revolved in an open direction further from the close state. The other end of the bearing bar can be moved to a side close to the first axis by the force rendering the other end of the bearing bar return to the vertical line passing through the second axis when the other end of the bearing bar is disengaged from the first concave surface. Accordingly, after the other end of the bearing bar is disengaged from the first concave surface, by revolving the revolving board in a direction to lay down (that is, downward and in a direction away from the first axis), the other end of the bearing bar is guided to the loop-shaped guiding channel to move downward of the guiding inclined plane, and the revolving board goes into a close state.

Thus, since the revolving board can be changed from the open state to the close state by performing only the revolving operation of the revolving board, it has an effect that the operation for adjusting the revolving board from the open state to the close state can be simplified. In addition, as a result, since it is not necessary to operate the revolving board with one hand while operating the bearing bar with the other hand when the revolving board is changed from the open state to the close state, the risk of pinching the other hand between the revolving board and the musical instrument body can be prevented.

In addition, in a state in which the revolving board is opened, the other end of the bearing bar is engaged with the first concave surface at the position which is further away from the first axis than the vertical line passing through the second axis (one end of the bearing bar); therefore, the revolving board can be supported by the bearing bar in a state in which a line connecting the one end and the other end of the bearing bar is arranged along a direction for laying down the revolving board. Therefore, the revolving board can be stably supported by the bearing bar.

According to a further aspect of the present invention, in the close state of the revolving board, the other end of the bearing bar is away from an outer peripheral wall of the guiding channel when the other end of the bearing bar is located on the vertical line passing through the second axis; therefore, when the revolving board is revolved in a direction to lay down, the revolution of the revolving board in the direction to lay down can be prevented from being restrained through the other end of the bearing bar abuts on the outer peripheral wall before the revolving board goes into a state of being closed completely. Therefore, the revolving board can be revolved in a direction to be laid down and as far as possible to a position in which it is down completely.

According to a further aspect of the present invention, the outer peripheral wall comprises a second concave surface, and the second concave surface is located above the first concave surface and on a side closer to the first axis than an upper end of the guiding inclined plane, and recesses upward in a valley shape; therefore, the other end of the bearing bar after finishing the guidance by the guiding inclined plane can be abutted on the second concave surface by revolving the revolving board in a direction to be opened. Hereby, the upward movement of the other end of the bearing bar and toward a side close to the first axis can be restrained by the second concave surface; therefore, the revolution of the revolving board in the direction to be opened can be restrained.

In addition, the second concave surface is located above the first concave surface and on a side further away from the first axis than the first concave surface; therefore, after the revolution of the revolving board in the direction to be opened is restrained, the other end of the bearing bar abutting on the second concave surface can be guided to the first concave surface by revolving the revolving board in a direction to lay down. As a result, the other end of the bearing bar is engaged with the first concave surface so that the revolving board can be supported by the bearing bar in an open state.

Thus, since the revolving board can be changed from a close state to an open state by revolving the revolving board in a direction to be opened as far as a position where the revolution is restrained and then revolving the revolving board in a direction to lay down after the revolution of the revolving board in the direction to be opened is restrained, it has an effect that the operability when adjusting the revolving board from a close state to an open state can be improved.

According to a further aspect of the present invention, the outer peripheral wall comprises a third concave surface, the third concave surface is located above the first concave surface and on a side closer to the first axis than the first concave surface, and recesses upward, therefore, by revolving the revolving board in a direction to be opened from the open state, the other end of the bearing bar is disengaged from the first concave surface and the other end of the bearing bar can be engaged to the third concave surface. Hereby, the movement upward of the other end of the bearing bar and toward a side close to the first axis can be restrained by the third concave surface, therefore, the revolution of the revolving board in a direction to be opened can be restrained. Moreover, after the revolution of the revolving board in the direction to be opened is restrained, by revolving the revolving board toward a direction to lay down, the other end of the bearing bar is guided to the guiding channel to move downward of the guiding inclined plane so that the revolving board can be laid down.

Thus, since the revolving board can be laid down by revolving the revolving board in a direction to be opened further from the open state and then revolving the revolving board in a direction to lay down after the revolution of the revolving board in the direction to be opened is restrained, it has an effect that the operability when adjusting the revolving board from the open state to the close state can be improved.

According to a further aspect of the present invention, the third concave surface is located in a range from the first concave surface toward a side closer to the first axis in a distance of two times of an outer diameter of the bearing bar, therefore, compared with a case which the third concave surface is located on a side closer to the first axis than the above range, it has an effect that the amount of the revolving operation of the revolving board in a direction to be opened when adjusting the revolving board from the open state to the close state can be reduced.

According to a further aspect of the present invention, the third concave surface engages the other end of the bearing bar when the revolving board is revolved at most five degrees from the open state in a direction of further opening the revolving board, therefore, compared with a case which the other end of the bearing bar is engaged by revolving the revolving board in the direction to be opened further by more than five degrees from the open state, it has an effect that the amount of the revolving operation of the revolving board in the direction to be opened when adjusting the revolving board from the open state to the close state can be reduced.

According to a further aspect of the present invention, the bearing bar is formed by bending an end and an other end of a rod-shaped member, therefore, it has an effect that a structure of the bearing bar can be simplified to reduce a manufacturing cost.

In addition, the bearing bar is formed in a squared U-shape so that a center of gravity of the bearing bar can be located on a side closer to the other end of the bearing bar in a state in which the one end of the bearing bar is supported on the revolving board. Accordingly, a force on which the other end of the bearing bar attempts to be located on the vertical line of the second axis can act more, therefore, it has an effect that the guiding ability of the other end of the bearing bar by the guiding channel of the guiding member can be improved.

According to a further aspect of the present invention, the bearing bar is composed of a metallic material so that the stiffness of the bearing bar can be increased. In addition, compared with a case which the bearing bar is composed of with a material lighter than a metallic material, such as a resin material, the center of gravity acting on the bearing bar can be ensured by miniaturizing the bearing bar while increasing the weight of the bearing bar, therefore, it has an effect that the guiding ability of the other end of the bearing bar by the guiding channel of the guiding member can be improved.

According to a further aspect of the present invention, the bearing bar includes a coating member made of a resin for coating an outer peripheral surface of the other end of the bearing bar, therefore, a coefficient of friction between the other end of the bearing bar coating the coating member and the inner peripheral wall and the outer peripheral wall forming the guiding channel can be decreased. Accordingly, the other end of the bearing bar guided to the guiding channel can slide better, therefore, it has an effect that the guiding ability of the other end of the bearing bar by the guiding channel of the guiding member can be improved.

Moreover, the coating member coats the other end of the guiding member, therefore, compared with a case which the guiding member coats the entire bearing bar, the weight on a side of the other end of the bearing bar can be increased. Accordingly, the gravity acting on the bearing bar can be located on a side closer to the other end of the bearing bar, therefore, it has an effect that the guiding ability of the other end of the bearing bar by the guiding channel of the guiding member can be improved. In addition, the coating member coats the other end of the guiding member, therefore, compared with a case which the guiding member coats the entire bearing bar, it has effects that increasing the size of the entire bearing bar can be prevented, and material cost of a resin material used for the coating member can be reduced.

According to a further aspect of the present invention, the musical instrument body includes a support having an opening and a blocking member in a plate shape blocking the opening of the support and detachably mounted on the support, wherein the revolving board is rotatably supported on a side of the blocking member and the guiding member is mounted on an other side of the blocking member, therefore, the blocking member, the revolving board and the guiding member can be configured as one revolving board unit. Accordingly, with respect to the revolving board unit, the one end of the bearing bar is supported by the revolving board in a rotatable manner and the other end of the bearing bar can be guided by the guiding channel of the guiding member. The bearing bar supports the blocking member in a state in which the bearing bar is supported by the revolving board unit. Thus, the revolving board, the guiding member and the bearing bar can be mounted on the musical instrument body.

Thus, the revolving board, the guiding member and the blocking member can be configured as one revolving board unit, and the block member can be mounted on the support in a state in which the bearing bar is supported by the revolving board unit, therefore, for example, compared with a case which one end of the bearing bar is supported by the revolving board while the other end of the bearing bar can be guided by the guiding channel of the guiding member, it has an effect that the effort for mounting the revolving board, the guiding member and the bearing bar on the musical instrument body can be simplified.

According to a further aspect of the present invention, the blocking member includes a notch formed in recess inward with respect to an axis direction of the second axis, the bearing bar is formed in a U-shape comprising a support shaft and an end leg and an other end leg, wherein the one end leg and the other end leg of the bearing bar are parallel to each other and parallel to an axis direction of the first axis, and the support shaft between the end leg and the other end leg inserts the notch of the blocking member, and the end leg of the support shaft is supported on the revolving board. The guiding member is mounted on the blocking member at a position where upward extensions of the inner peripheral wall and the outer peripheral wall of the guiding channel are parallel to the axis direction of the other end leg of the bearing bar, and the other end of the bearing bar can be guided to the guiding channel, therefore, the notch formed on the blocking member and the bearing bar inserted to the notch can be disposed on an end part of the bearing bar. Hereby, compared with a case which the notch is penetrated through a central part of the blocking member, the notch and the bearing bar can be disposed at an inconspicuous position, therefore, it has an effect that a better appearance can be obtained.

According to a further aspect of the present invention, in a case when the blocking member is mounted on the support, a separation distance L1 exists between an end on a side of the guiding channel of the guiding member where the bearing bar is disposed and the support facing to the end. A length L2 along the axis direction of the other end of the bearing bar is set to be larger than the separation distance L1. Through the movement in the axis direction of the other end of the bearing bar is restrained, the other end of the bearing bar can be prevented from departing from the guidable state by moving to a side closer to the support than the end part on the side which the bearing bar of the guiding channel of the guiding member is disposed. Accordingly, it is unnecessary to restrain the movement in the axis direction of the one end of the bearing bar supported by the revolving board, therefore, it has effects that the structure of supporting the one end of the bearing bar to the revolving board can be simplified, and the effort for supporting the one end of the bearing bar to the revolving board can be simplified.

According to a further aspect of the present invention, the inner peripheral wall comprises a fourth concave surface located on a side closer to the first axis than the first concave surface, and recesses downward. Therefore, by further revolving the revolving board from a state in which the other end of the bearing bar is supported on the first concave surface, the other end of the bearing bar can be guided to the guiding channel while engaging with the fourth concave surface. Through the other end of the bearing bar is engaged with the fourth concave surface while keeping the open state of the revolving board, an angle of the revolving board to the musical instrument body can be changed from the open state of the revolving board when the other end of the bearing bar is engaged with the first concave surface, therefore, it has an effect that the angle of the revolving board to the musical instrument body can be selected according to performer's preference.

Several exemplary embodiments accompanied with figures are described in detail below to further describe the present invention in detail.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the invention.

DETAILED DESCRIPTION OF DISCLOSED EMBODIMENTS

Preferred embodiments of the present invention are described in detail with reference to the accompanying drawings. First, referring to FIG. 1, a configuration of a keyboard instrument 1 according to a first embodiment of the invention is described.

Figure 1:
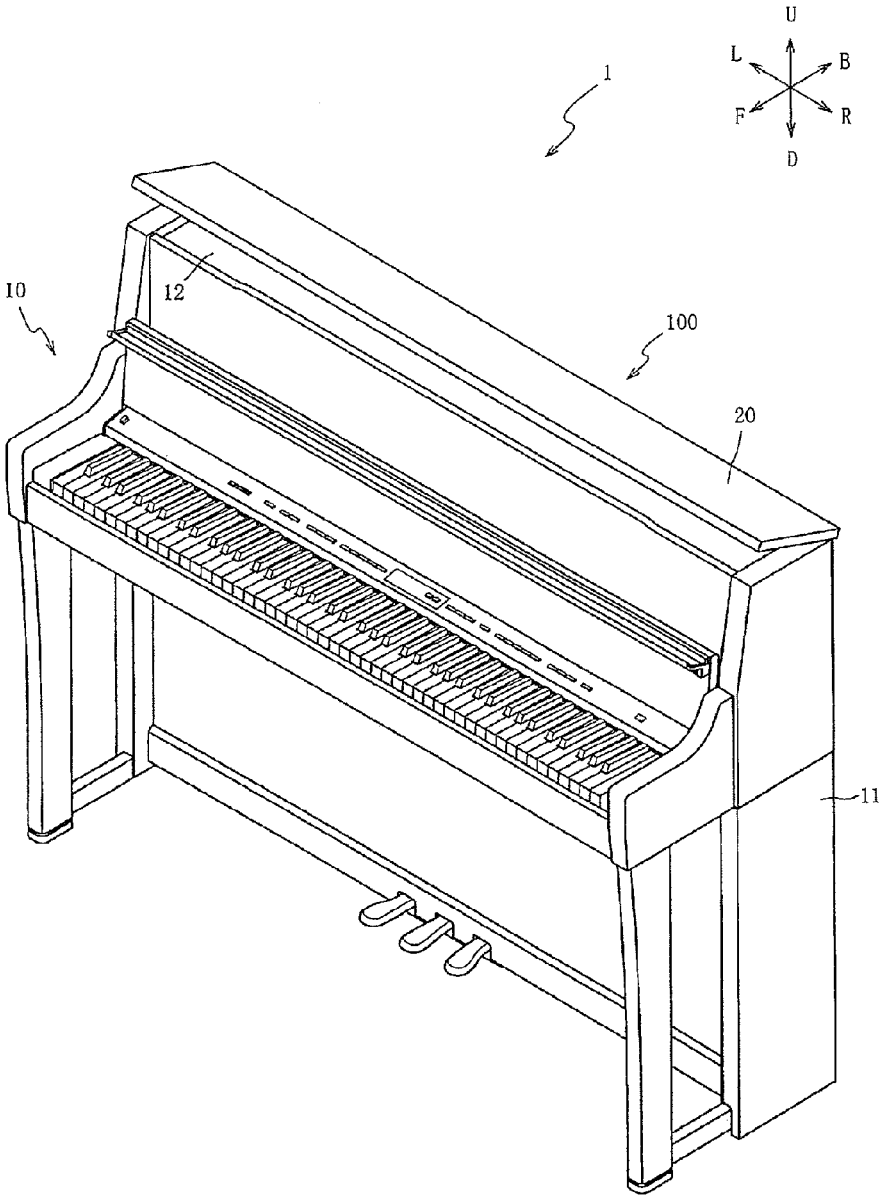
FIG. 1 is a perspective view of a keyboard instrument according to a first embodiment of the invention.

FIG. 1 is a perspective view of the keyboard instrument 1 according to the first embodiment of the invention. Besides, arrows U-D, L-R and F-B in FIG. 1 respectively indicate an up-down direction, a left-right direction and a front-back direction of the keyboard instrument 1, and likewise hereinafter.

Figure 6:
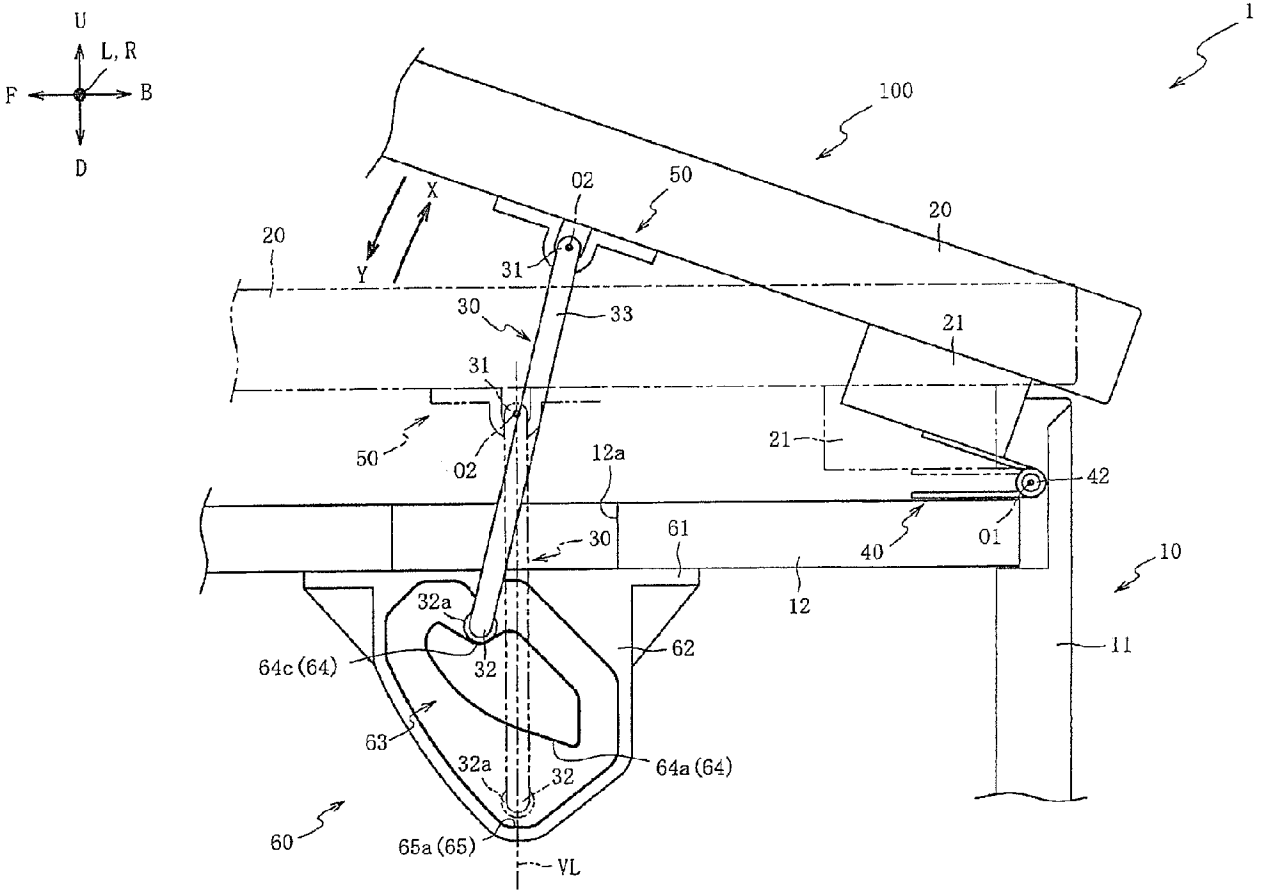
FIG. 6 is a partial side view of the keyboard instrument in a state in which the lid is opened.

As shown in FIG. 1, the keyboard instrument 1 is a piano which has a plurality of white keys and black keys to be depressed by a performer, and is mainly configured with a musical instrument body 10 generating sound by a performer, a lid 20 mounted on an upper part of the musical instrument body 10 in a rotatable manner, and a bearing bar 30 supporting the lid 20 with respect to the musical instrument body 10 under the situation that the lid 20 is opened (see FIG. 6). In addition, the musical instrument body 10 includes a support 11 in a box shape having an opening on an upper part and a blocking member 12 in a plate shape blocking the opening of the support 11, wherein the lid 20 is rotatably mounted to the blocking member 12.

Besides, through the lid 20 and a guiding member 60, described later (see FIG. 2), are mounted on the blocking member 12, the lid 20, the guiding member 60 and the blocking member 12 are configured as one lid unit 100.

Figure 2:
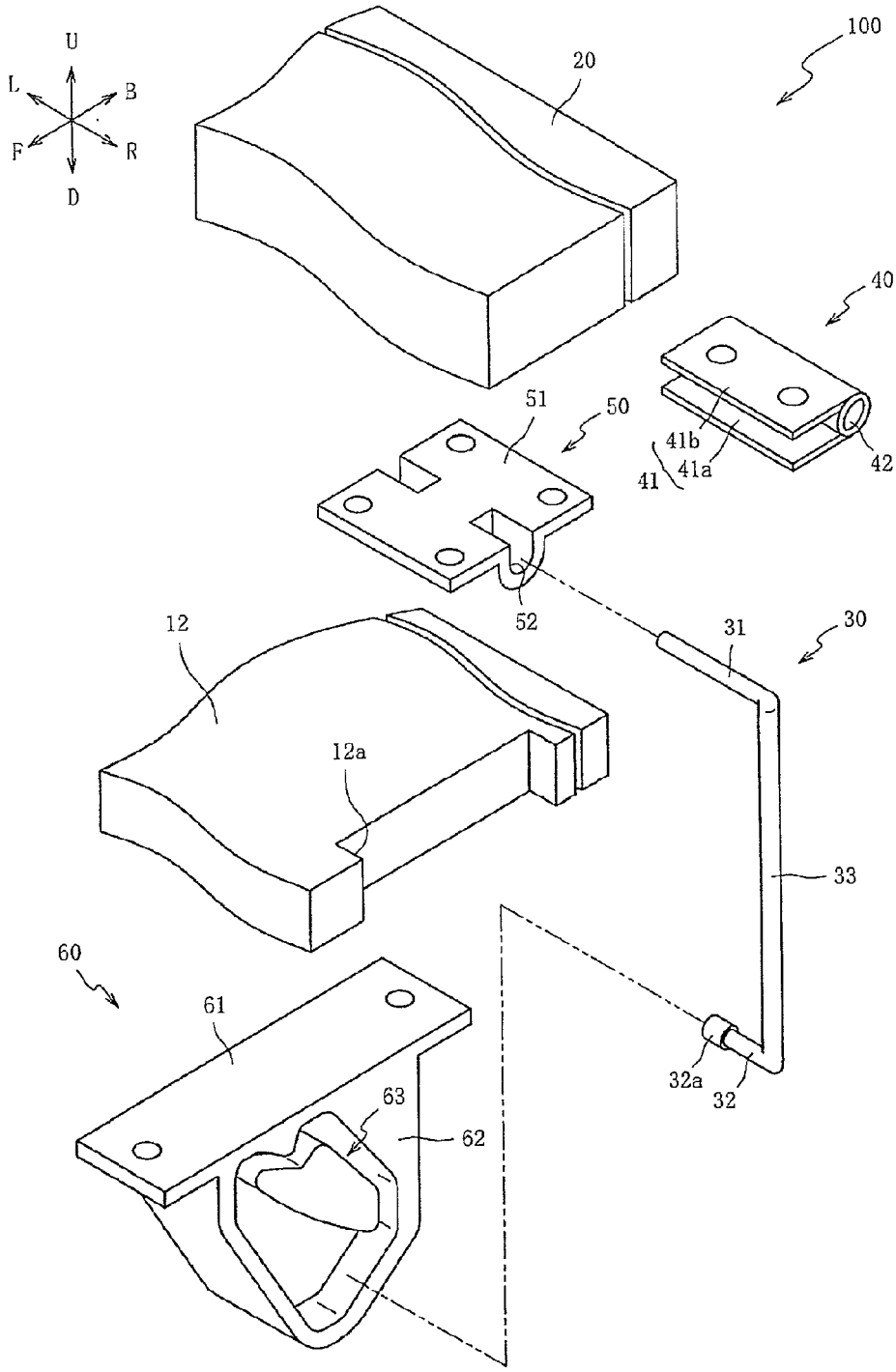
FIG. 2 is an exploded perspective view of a bearing bar and a lid unit.
Figure 3B:
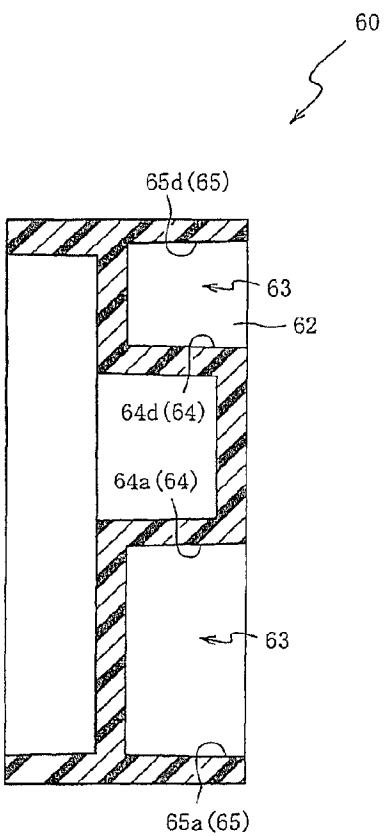
FIG. 3B is a cross section of the guiding member along IIIb-IIIb in FIG. 3A.
Figure 3A:
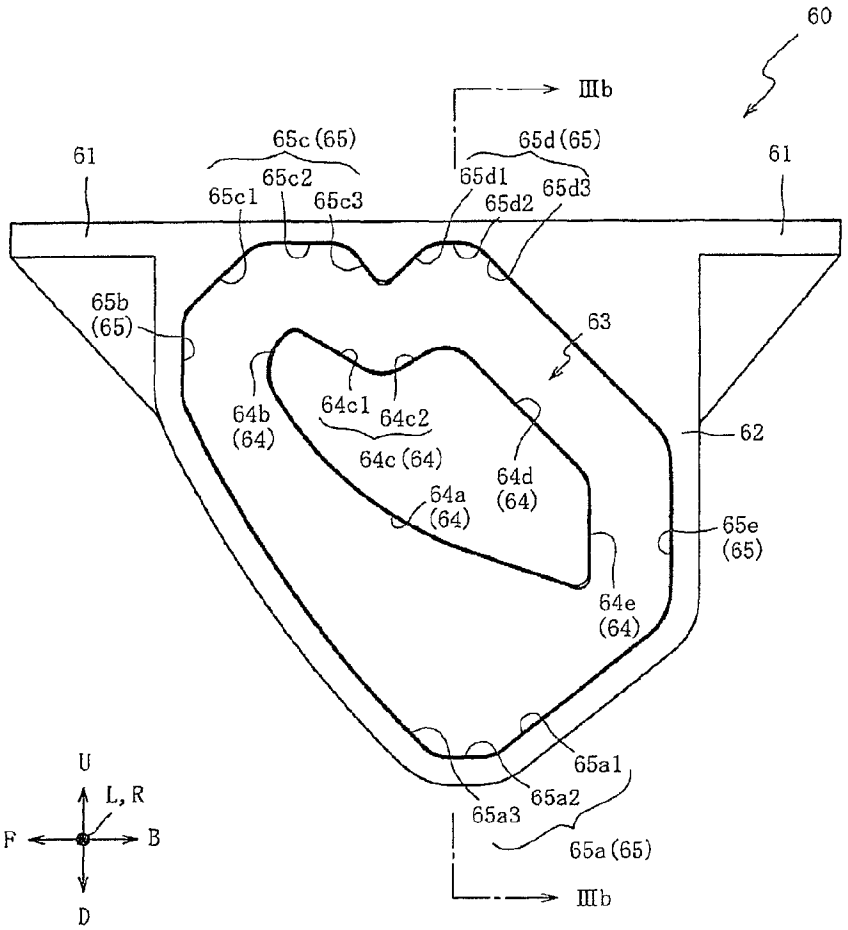
FIG. 3A is a front view of a guiding member.

Next, referring to FIG. 2 and FIGS. 3A and 3B, detailed configurations of the bearing bar 30 and the lid unit 100 are described. FIG. 2 is an exploded perspective view of the bearing bar 30 and the lid unit 100. FIG. 3A is a front view of the guiding member 60, and FIG. 3B is a cross section of the guiding member 60 along IIIb-IIIb in FIG. 3A. Besides, in FIG. 2, only the right side part of the lid unit 100 is shown, and the left side part of the lid unit 100 has the same configuration as the right side part of the lid unit 100 and has been omitted from the illustration.

As shown in FIG. 2, the bearing bar 30 is a member formed in an approximate U-shape by bending one end and the other end of a rod-shaped member composed of a metallic material, and the bearing bar 30 includes a shaft supported member 31 formed on one end of the bearing bar 30, a guided part 32 formed on the other end of the bearing bar 30 and disposed in a manner of that an axis direction of the shaft supported member 31 and an axis direction of the guided part 32 are approximately parallel to each other, and a connecting part 33 connecting the shaft supported member 31 and the guided part 32 and disposed in a manner that an axis direction of the connecting part 33 is approximately vertical to the axis directions of the shaft supported member 31 and the guided part 32.

The bearing bar 30 is composed of a metallic material so that the stiffness of the bearing bar 30 can be increased. In addition, the bearing bar 30 is formed by bending the one end and the other end of the rod-shaped member composed of a metallic material; therefore, a structure of the bearing bar 30 can be simplified and a manufacturing cost of the bearing bar 30 can be reduced.

The shaft supported member 31 is a part supported on the lid 20 in a rotatable manner. The guided part 32 is a part which is guided by the guiding member 60, and includes a coating member 32*a* made of resin for coating an outer peripheral surface of the guided part 32.

Besides, in the embodiment, the length along the axis direction of the shaft supported member 31 is set to be larger than the length along the axis direction of the guided part 32. However, the embodiment herein is not intended to restrict the scope of this invention. The length along the axis direction of the shaft supported member 31 can be set to be same as the length along the axis of the guided part 32, or can be smaller than the length along the axis direction of the guided part 32.

The lid unit 100 is configured with the blocking member 12, the lid 20 disposed facing an upper surface side of the blocking member 12, a hinge 40 connecting the blocking member 12 and the lid 20, a shaft-supporting member 50 mounted on a surface facing to the blocking member 12 of the lid 20, and the guiding member 60 mounted on the other surface side (lower side in FIG. 2) of the blocking member 12. Besides, in the embodiment, the hinge 40, the shaft-supporting member 50 and the guiding member 60 are disposed one each at the left and right sides of the blocking member 12.

The blocking member 12 is a plate-shaped member made of wood, wherein a notch 12*a* which is inwardly recessed at the left and/or right side surfaces of the blocking member 12, is formed in a central part of a front-back direction of the blocking member 12.

The lid 20 is a wooden member in a plate shape and the dimensions of which in the front-back direction and the left-right direction are set to be larger than those of the blocking member 12, wherein a hinge mounting part 21 (see FIG. 4) for mounting the hinge 40 is protruded on a back part of a lower surface side of the lid 20 and a support abutting part 22 (see FIG. 4) abutting on an upper surface of the support 11 (see FIG. 4) is disposed on a front part of the lid 20 under a close state of the lid 20.

The hinge 40 is a member supporting the lid 20 in a rotatable manner on the blocking member 12. The hinge 40 includes a pair of connecting plates 41 formed in a plate shape and a shaft member 42 pivoting a pair of the connecting plates 41. A connecting plate 41*a*, of the pair of the connecting plates 41, is mounted on an upper surface of the blocking member 12 by a bolt (not shown), and the other connecting plate 41*b* is mounted on a lower surface of the lid 20 by a bolt (not shown). The lid 20 and the blocking member 12 are hereby connected by the hinge 40, and the lid 20 is supported on the blocking member 12 in a rotatable manner with an axis 01 (see FIG. 5) of the shaft member 42 of the hinge 40 as a revolving center.

The shaft-supporting member 50 is a member made of resin. The shaft-supporting member supports the shaft supported member 31 in a rotatable manner with respect to the lid 20. The shaft-supporting member 50 includes a shaft-supporting member mounting part 51 in a plate shape and an insertion channel 52 formed below the shaft-supporting member mounting part 51. The insertion channel 52 is a channel into which the shaft supported member 31 of the bearing bar 30 is inserted. The shaft supported member 31 of the bearing bar 30 is inserted into the insertion channel 52 under a state that the shaft-supporting member 50 is mounted on the lid 20. The bearing bar 30 is supported on the lid 20 in a rotatable manner with an axis 02 (see FIG. 5) as a revolving center. In a state that the lid 20 is connected to the blocking member 12 by the hinge 40, the shaft-supporting member 50 is configured in such a manner that a front-back position of the shaft-supporting member 50 is equal to a front-back position of the notch 12*a* of the blocking member 12 and a left-right position of the shaft-supporting member 50 is slightly shifted inwardly from the notch 12*a* of the blocking member 12. In such a configuration of the shaft-supporting member 50, the shaft-supporting member mounting part 51 is mounted on the lower surface side of the lid 20 by the bolt (not shown) under a state that a longitudinal direction of the insertion channel 52 is in the left-right direction of the keyboard instrument and the axis 02 of the shaft supported member 31 of the bearing bar 30 passing through the insertion channel becomes parallel to the axis 01 of the shaft member 42 of the hinge 40 (see FIG. 4 and FIG. 5).

The guiding member 60 is a member made of resin guiding the guided part 32 of the bearing bar 30. The guiding member includes a guiding mounting part 61 in a plate shape, a guide body 62 formed below the guiding mounting part 61, and a guiding channel 63 in a loop shape recessed on one surface side of the guide body 62. The guiding member 60 is configured in such a manner that a front-back position of the guiding member 60 is equal to a front-back position of the notch 12*a* of the blocking member 12 and a left-right position of the guiding member 60 is slightly shifted inwardly of the left-right position of the notch 12*a* of the blocking member 12. In such a configuration of the guiding member 60, the guiding mounting part 61 is mounted on a lower surface side of the blocking member 12 by a bolt (not shown) under a state that the one side of the guide body 62 recessed in the guiding channel 63 is facing outwardly of the left-right direction (right side in FIG. 2) of the blocking member 12 (see FIG. 4 and FIG. 5).

Besides, the length along the axis of the connecting part 33 of the bearing bar 30 is a separation distance between the shaft supported member 31 and the guided part 32. The length along the axis of the connecting part 33 is larger than a separation distance in a vertical direction between a lower end of the insertion channel 52 of the shaft-supporting member 50 and a first incline surface 64*a* of an inner peripheral wall 64 of the guiding member 60 (see FIG. 3B) under a state that the lower surface of the lid 20 and the upper surface of the blocking member 12, which are connected by the hinge 40, are parallel and facing each other (that is, under a close state of the lid 20). The length along the axis of the connecting part 33 is smaller than the separation distance in a vertical direction between the lower end of the insertion channel 52 of the shaft-supporting member 50 and an outer peripheral first concave surface 65*a* of an outer peripheral wall 65 of the guiding member 60 (see FIG. 3B). Hereby, when the shaft supported member 31 of the bearing bar 30 is supported by the lid 20 in a rotatable manner by the shaft-supporting member 50 under a state that the lower surface of the lid 20 and the upper surface of the blocking member 12 that are connected by the hinge 40 are parallel and facing each other, the guided part 32 of the bearing bar 30 can be disposed between the first incline surface 64*a* of the inner peripheral wall 64 and the outer peripheral first concave surface 65*a* of the outer peripheral wall 65 of the guiding member 60 (see FIG. 5).

Herein, it is preferred to use a resin material for the coating member 32*a*, the shaft-supporting member 50 and the guiding member 60 to coat the guided part 32 of the bearing bar 30. In the embodiment, the coating member 32*a* of the guided part 32 of the bearing bar 30 is composed of thermoplastic polyester elastomer, and the shaft-supporting member 50 and the guiding member 60 are composed of POM (polyacetal) which is harder than the thermoplastic polyester elastomer. Because the coating member 32*a* is composed of a soft resin material, noise during colliding with the guiding member 60 can be reduced; and because the shaft-supporting member 50 and the guiding member 60 are composed of a hard resin material, stiffness can be ensured. Besides, resin materials used in the embodiment are just examples; the coating member 32*a*, the shaft-supporting member 50 and the guiding member 60 can be composed of a resin material, such as ABS, other than the materials described above.

In addition, in the embodiment, the bearing bar 30, the hinge 40, the shaft-supporting member 50 and the guiding member 60 are disposed on both right and left sides of the lid unit 100. Accordingly, the lid 20 can be stably revolved against the blocking member 12. Besides, the bearing bar 30, the hinge 40, the shaft-supporting member 50 and the guiding member 60 can be disposed only on either side of the left or right direction of the lid unit 100. Hence, the material cost and the manufacturing cost can be reduced. In this case, the notch 12*a* of the blocking member 12 also can be disposed only on either side of the blocking member 12 along the left or right direction.

As shown in FIG. 3A and FIG. 3B, the guiding channel 63 includes the inner peripheral wall 64 forming a wall surface on an inner peripheral side of the guiding channel 63 and the outer peripheral wall 65 disposed at a position which is facing the inner peripheral wall 64 and forming a wall surface on an outer peripheral side of the guiding channel 63.

The inner peripheral wall 64 includes the first incline surface 64*a* inclining upward as it extends in a forward direction, a second incline surface 64*b* connected to an upper end of the first incline surface 64*a* and inclining upward as it extends in a backward direction, an inner peripheral concave surface 64*c* in a valley shape connected to an upper end of the second incline surface 64*b* and recessed downward, a third incline surface 64*d* connected to a back end of the inner peripheral concave surface 64*c* and inclining downward as it extends a backward direction, and an inner peripheral vertical surface 64*e* connecting a lower end of the third incline surface 64*d* and a lower end of the first incline surface 64*a* and extended along an up-down direction.

The inner peripheral concave surface 64*c* includes an inner peripheral downward-facing inclined concave surface 64*c*1 inclining downward as it extends in a backward direction and an inner peripheral upward-facing inclined concave surface 64*c*2 connected to a lower end of the inner peripheral downward-facing inclined concave surface 64*c*1 and inclining upward as it extends in a backward direction.

The outer peripheral wall 65 includes an outer peripheral first concave surface 65*a* disposed facing the first incline surface 64*a* of the inner peripheral wall 64, an outer peripheral first vertical surface 65*b* connected to a front end of the outer peripheral first concave surface 65*a* and extended upward, an outer peripheral second concave surface 65*c* in a valley shape located further backward than the outer peripheral first vertical surface 65*b* and connected to an upper end of the outer peripheral first vertical surface 65*b* and recessed upward, an outer peripheral third concave surface 65*d* in a valley shape located backward of the outer peripheral second concave surface 65*c* and connected to the back end of the outer peripheral second concave surface 65*c* and recessed upward, and an outer peripheral second vertical surface 65*e* connecting a back end of the outer peripheral third concave surface 65*d* and a back end of the outer peripheral first concave surface 65*a* and extended along an up-down direction.

The outer peripheral first concave surface 65*a* includes an outer peripheral first downward-facing inclined concave surface 65*a*1 inclining downward as it extends in a forward direction, and an outer peripheral first horizontal concave surface 65*a*2 connected to a lower end of the outer peripheral first downward facing inclined concave surface 65*a*1 and extended horizontally in a forward direction, and an outer peripheral first upward facing inclined concave surface 65*a*3 connected to a front end of the outer peripheral first horizontal concave surface 65*a*2 and inclining upward as it extends in a forward direction. The outer peripheral second concave surface 65*c* includes an outer peripheral second upward facing inclined concave surface 65*c*1 inclining upward as it extends in a backward direction, and an outer peripheral second horizontal concave surface 65*c*2 connected to an upper end of the outer peripheral second upward facing inclined concave surface 65*c*1 and extended horizontally in a backward direction, and an outer peripheral second downward facing inclined concave surface 65*c*3 connected to a back end of the outer peripheral second horizontal concave surface 65*c*2 and inclining downward as it extends in a backward direction. The outer peripheral third concave surface 65*d* includes an outer peripheral third upward facing inclined concave surface 65*d*1 inclining upward as it extends in a backward direction, and an outer peripheral third horizontal concave surface 65*d*2 connected to an upper end of the outer peripheral third upward facing inclined concave surface 65*d*1 and extended horizontally backward, and an outer peripheral third downward facing inclined concave surface 65*d*3 connected to a back end of the outer peripheral third horizontal concave surface 65*d*2 and inclining downward as it extends a backward direction.

The guiding channel 63 is configured such that separation distances between surfaces of the inner peripheral wall 64 and the outer peripheral wall 65 are approximately the same except for the first incline surface 64*a* and the outer peripheral first concave surface 65*a*. A separation distance between the first incline surface 64*a* and the outer peripheral first concave surface 65*a* is larger than the separation distance between the inner peripheral wall 64 and the outer peripheral wall 65 in other part of the guiding channel 63.

The lower end of the third incline surface 64*d* and the lower end of the first incline surface 64*a* in the inner peripheral wall 64 are connected through the inner peripheral vertical surface 64*e* extended along the up-down direction. In comparing the former with a case that the lower end of the third incline surface 64*d* and the lower end of the first incline surface 64*a* are directly connected, the strength of a connection part of the lower end of the third incline surface 64*d* and the lower end of the first incline surface 64*a* can be ensured in the former; also in the former, the size in a front-back direction of the guide body 62 can be restrained from being further increased.

That is to say, in a case of which the lower end of the third incline surface 64*d* and the lower end of the first incline surface 64*a* are directly connected by further steepening a tilt angle in a front-back direction for the third incline surface 64*d*, an angle formed by the third incline surface 64*d* and the first incline surface 64*a* becomes smaller; therefore, the strength of the connection part of the lower end of the third incline surface 64*d* and the lower end of the first incline surface 64*a* is decreased. In addition, in a case when the angle formed by the third incline surface 64*d* and the first incline surface 64*a* is larger by setting the tilt angle to the front-back direction of the third incline surface 64*d* to be larger, the outer peripheral wall 65 facing the lower end of the third incline surface 64*d* becomes a shape that the outer peripheral wall 65 is projected a lot more to a back side; therefore, the size in the front-back direction of the guide body 62 is increased.

In contrast, the lower end of the third incline surface 64*d* and the lower end of the first incline surface 64*a* are connected through the inner peripheral vertical surface 64*e*; therefore, the strength can be ensured by increasing the angle formed by the connecting part of the lower end of the third incline surface 64*d* and the lower end of the first incline surface 64*a* and the inner peripheral vertical surface 64*e*. Further, at the same time, increasing the size of the guide body 62 along the front-back direction can be mitigated by reducing the size of the third incline surface 64*d* extending along the back side.

Moreover, the front end of the outer peripheral first concave surface 65*a* and a front end of the outer peripheral second concave surface 65*c* of the outer peripheral wall 65 are connected through the outer peripheral first vertical surface 65*b* that extends along the up-down direction, and the back end of the outer peripheral third concave surface 65*d* and the back end of the outer peripheral first concave surface 65*a* are connected through the inner peripheral second vertical surface 64*e* that extends along the up-down direction. Therefore, compared with a case that the front end of the outer peripheral first concave surface 65*a* and front end of the outer peripheral second concave surface 65*c* are directly connected or a case that the back end of the outer peripheral third concave surface 65*d* and the back end of the outer peripheral first concave surface 65*a* are directly connected, the projection size along the front-back direction of the outer peripheral wall 65 can be reduced. As a result, increasing the size in the front-back direction of the guide body 62 can be reduced.

Similarly, the outer peripheral first concave surface 65*a*, the outer peripheral second concave surface 65*c* and the outer peripheral third concave surface 65*d* of the outer peripheral wall 65 respectively includes the outer peripheral first horizontal concave surface 65*a*2, the outer peripheral second horizontal concave surface 65*c*2 and the outer peripheral third horizontal concave surface 65*d*2 extended along front-back directions. Therefore, the size in an up-down direction of the guide body 62 can be reduced.

Besides, in the inner peripheral wall 64, the inner peripheral vertical surface 64*e* can be omitted, and the lower end of the third incline surface 64*d* and the lower end of the first incline surface 64*a* can be directly connected. In the outer peripheral wall 65, the outer peripheral first vertical surface 65*b* or the outer peripheral second vertical surface 65*e* can be omitted, and the front end of the outer peripheral first concave surface 65*a* and the front end of the outer peripheral second concave surface 65*c* or the back end of the outer peripheral third concave surface 65*d* and the back end of the first incline surface 64*a* can be directly connected. Similarly, in the outer peripheral first concave surface 65*a*, the outer peripheral second concave surface 65*c* and the outer peripheral third concave surface 65*d* on the outer peripheral wall 65, the outer peripheral first horizontal concave surface 65*a*2, the outer peripheral second horizontal concave surface 65*c*2 and the outer peripheral third horizontal concave surface 65*d*2 can be omitted, and the outer peripheral first downward facing inclined concave surface 65*a*1 and the outer peripheral first upward facing inclined concave surface 65*a*3, the outer peripheral second upward facing inclined concave surface 65*c*1 and the outer peripheral second downward facing inclined concave surface 65*c*3 or the outer peripheral third upward facing inclined concave surface 65*d*1 and the outer peripheral third downward facing inclined concave surface 65*d*3 can be directly connected.

Figure 4:
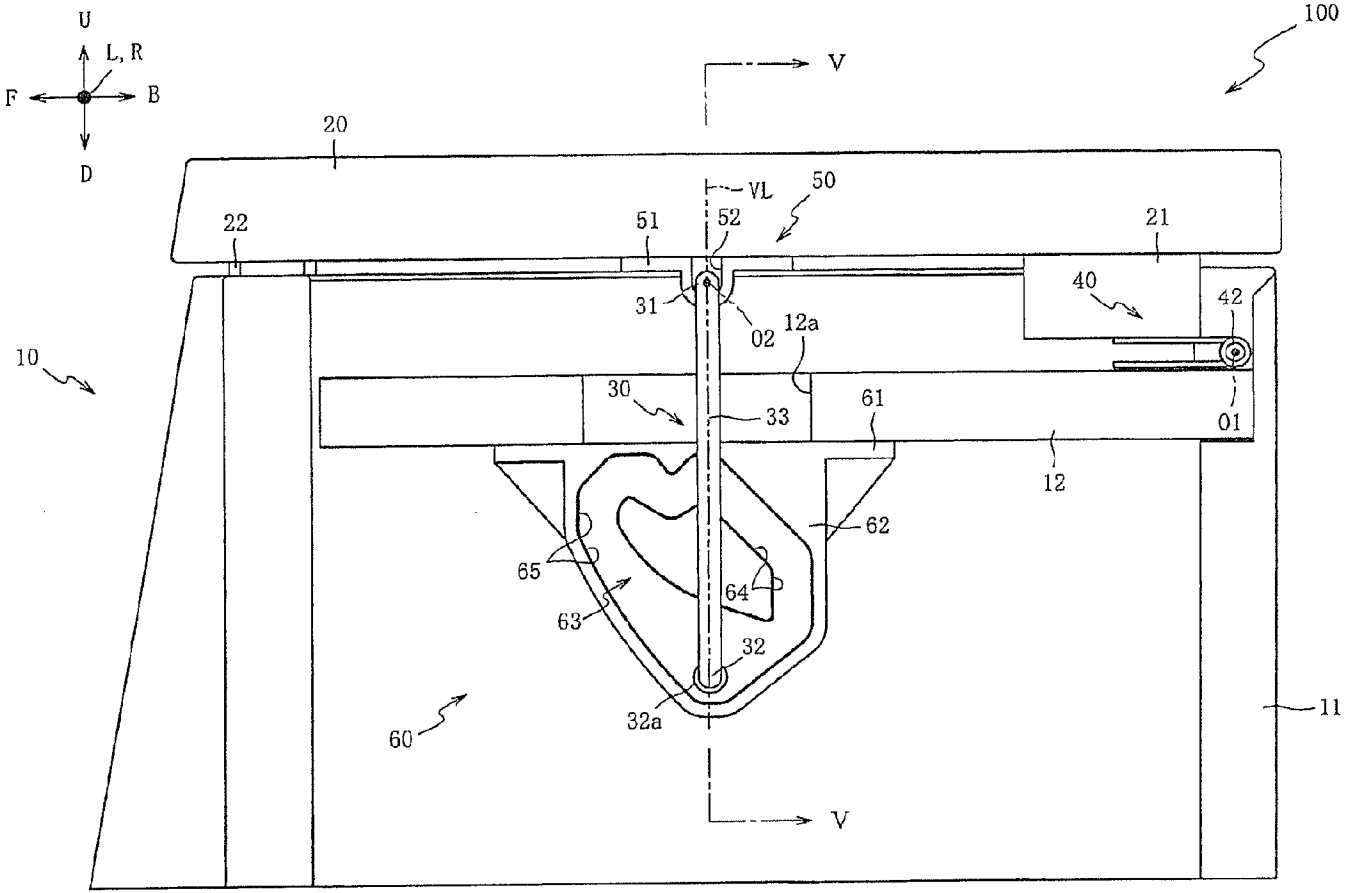
FIG. 4 is a partial side view of the keyboard instrument in a state in which the lid is closed.
Figure 5:
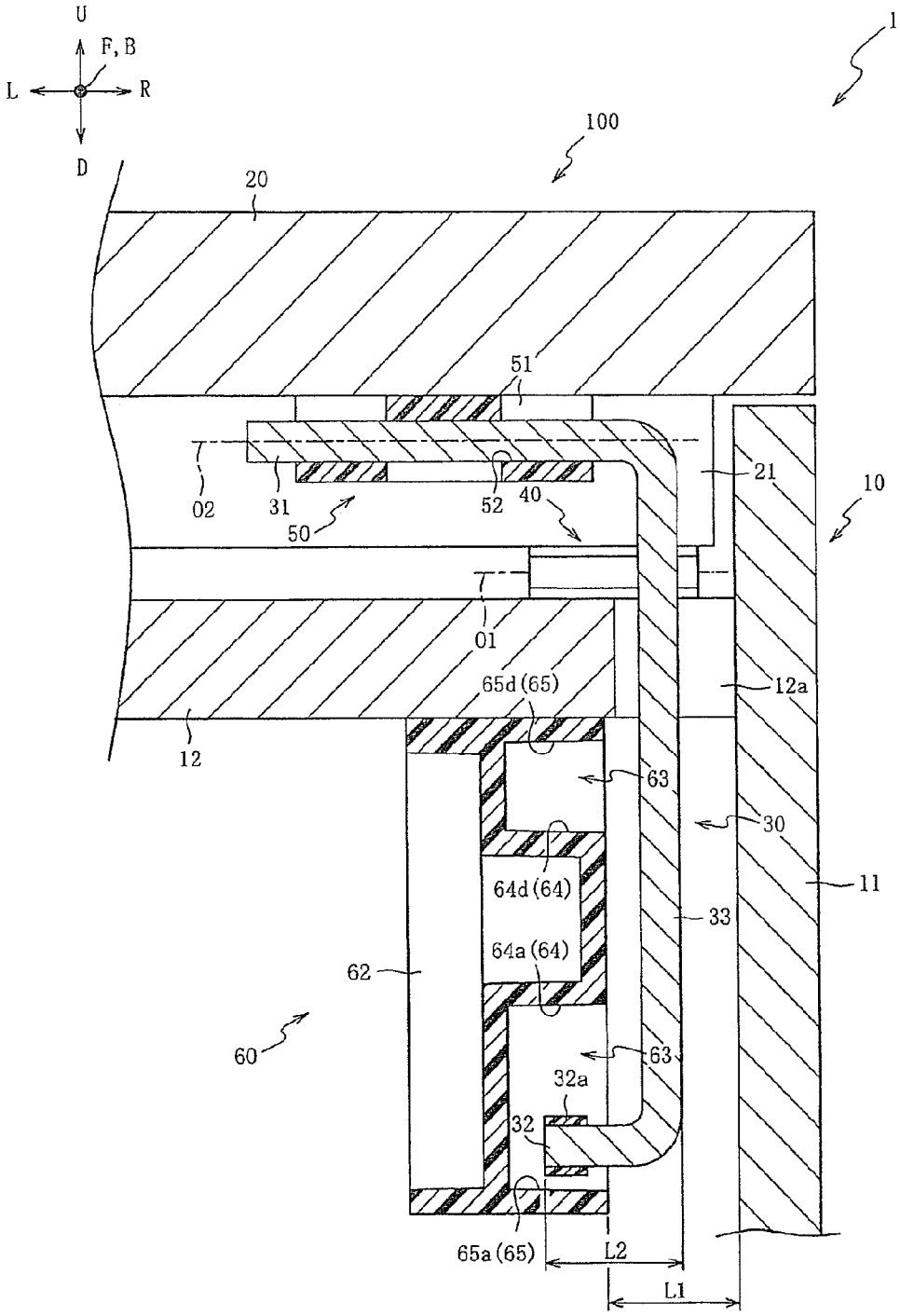
FIG. 5 is a cross section of the keyboard instrument along V-V line in FIG. 4.

Next, referring to FIG. 4 and FIG. 5, an assembling method of the bearing bar 30 and the lid unit 100 to the support 11 is described. FIG. 4 is a partial side view of the keyboard instrument 1 in a state in which the lid 20 is down. FIG. 5 is a cross section of the keyboard instrument 1 along V-V line in FIG. 4. Besides, in order to simplify the drawing and facilitate understanding, a side plate on a right side of the support 11 of the keyboard instrument 1 is not shown in FIG. 4, and the side plate on the right side of the support 11 is shown in FIG. 5.

As shown in FIG. 4 and FIG. 5, the bearing bar 30 is supported by the lid 20 in a rotatable manner rotating with the axis 02 of the shaft supported member 31 as a revolving center through the shaft supported member 31, which is inserted to the insertion channel 52 of the shaft-supporting member 50 mounted on the lid 20. The lid 20, the blocking member 12 and the guiding member 60 are configured as one lid unit 100. By inserting the shaft supported member 31 of the bearing bar 30 into the insertion channel 52 of the shaft-supporting member 50 under the condition that the lower surface of the lid 20 and the upper surface of the blocking member 12, which is connected by the hinge 40 to the lower surface side of the lid 20, are parallel and face each other, the guided part 32 of the bearing bar 30 is disposed between the inner peripheral wall 64 and the outer peripheral wall 65 of the guiding channel 63 in the guiding member 60, and the connecting part 33 of the bearing bar 30 is disposed inside the notch 12*a* of the blocking member 12.

In a case when a hole for inserting the connecting part 33 of the bearing bar 30 is formed on a position which is away from a side end of the blocking member 12, it is necessary to insert the connecting part 33 into the hole by moving the bearing bar 30 in an up-down direction. Accordingly, when the shaft supported member 31 of the bearing bar 30 is inserted into the insertion channel 52 of the shaft-supporting member 50, after the connecting part 33 is inserted into the hole by inserting the bearing bar 30 from an up-down direction of the hole, it is necessary to maintain the connecting part 33 being inserted into the hole while the shaft supported member 31 is inserted into the insertion channel 52 by relatively moving the shaft supported member 31 and the insertion channel 52 of the shaft-supporting member 50 in a left-right direction. Therefore, the effort for supporting the bearing bar 30 by the lid 20 is complicated.

In contrast, in the embodiment that the notch 12*a* is formed on the left-or-right end surface of the blocking member 12, the connecting part 33 of the bearing bar 30 can thereby be disposed inside the notch 12*a* only by inserting the shaft supported member 31 of the bearing bar 30 into the insertion channel 52 of the shaft-supporting member 50. Therefore, the effort for supporting the shaft supported member 31 of the bearing bar 30 on the lid 20 can be simplified.

In the lid unit 100, the blocking member 12 is fixed to the support 11 by using a bolt or a support fitting (not shown) in a state in which the bearing bar 30 is supported by the lid 20. Hence, the lid 20 can be mounted on the musical instrument body 10. Therefore, compared with a case in which the lid 20, the blocking member 12 and the guiding member 60 are mounted on the support 11 separately or a case in which the lid 20, the blocking member 12 and the guiding member 60 are mounted on the musical instrument body 10, the effort for mounting the lid 20, the guiding member 60 and the bearing bar 30 can be simplified.

Besides, the hinge mounting part 21 is protruded on the lower surface side of the lid 20, and by adjusting the size of the hinge mounting part 21 in an up-down direction, the support abutting part 22 of the lid 20 can be abutted on the upper surface of the support 11 when the lid 20 is horizontally laid down in a state in which the blocking member 12 is mounted on the support 11.

In addition, in the blocking member 12, the notch 12*a* is formed on the left or right side of the blocking member 12; therefore, compared with a case in which a hole for inserting the connecting part 33 of the bearing bar 30 is located on a center part of the blocking member 12, the notch 12*a* and the bearing bar 30 can be disposed on an inconspicuous location such that the blocking member 12 is mounted on the support 11, and a better appearance can be obtained.

Moreover, the guided member 60 is set such that a length L1 is smaller than a length L2. The length L1 is between an outer end part (end part on a right side in FIG. 5) along the left-and-right sides of the inner peripheral wall 64 and the outer peripheral wall 65 (vertical arrangement direction of the inner peripheral wall 64 and the outer peripheral wall 65) and an inner peripheral surface of a side plate of the support 11 (side wall on a left side in FIG. 5) facing the outer end part along the left-and-right sides of the inner peripheral wall 64 and the outer peripheral wall 65. The length L2 is a length in the axis direction of the guided part 32 of the bearing bar 30. Hereby, by restraining the movement toward the outside of the left-and-right side of the bearing bar 30 by the side plate of the support 11, a tip of the guided part 32 can be prevented from moving further outside along the left-right direction than the end part outside of the left-right direction of the inner peripheral wall 64 and the outer peripheral wall 65, therefore, the guided part 32 by the guiding channel can be prevented from being unable to guide.

As a result, it is unnecessary to restrain the movement toward the axis 02 of the shaft supported member 31 of the bearing bar 30, which is supported by the shaft-supporting member 50 in a rotatable manner. That is, providing a structure for restraining the movement toward the axis 02 to the shaft-supporting member 50 of the shaft supported member 31 on the shaft-supporting member 50 or the shaft supported member 31 can be unnecessary. Therefore, the structures of the shaft-supporting member 50 and the bearing bar 30 can be simplified. Moreover, only the shaft supported member 31 is inserted into the insertion channel 52 of the shaft-supporting member 50 for supporting the shaft supported member 31 of the bearing bar 30 by the shaft-supporting member 50, and another operation and process for restraining the movement toward the axis 02 of the shaft supported member 31 is unnecessary. Therefore, the effort for supporting the bearing bar 30 on the lid 20 can be simplified.

Besides, in a case that the length of the shaft supported member 31 of the bearing bar 30 in the axis 02 is set to be smaller than the length along the axis of the guided part 32, it is preferred that the length of the shaft supported member 31 along the axis 02 is set to be larger than the distance between an outer end part of the left or right side of the insertion channel 52 of the shaft-supporting member 50 and the inner peripheral surface of the side plate of the support 11 facing the end part outside the left or right side of the insertion channel 52 of the shaft-supporting member 50. Hereby, the shaft supported member 31 can be prevented from getting out of the insertion channel 52 of the shaft-supporting member 50 by restraining the movement toward the outside of the left or right side of the bearing bar 30 by the side plate of the support 11.

Moreover, when the lid 20 is closed and the guided part 32 of the bearing bar 30 is located on a vertical line VL passing through the axis 02 of the shaft supported member 31, the coating member 32*a* coating the guided part 32 is away from the outer peripheral wall 65 of the guiding channel 63. Accordingly, before the lid 20 is in a completely closed state (the support abutting part 22 of the lid 20 abuts on the upper surface of the support 11), the abutting of the coating member 32*a* against on the outer peripheral wall 65 can be prevented and the revolving of the lid 20 in a direction to close the lid 20 is not restrained. Therefore, the lid 20 can revolve in a direction to lay the lid 20 down till the lid 20 is completely closed.

In addition, the guiding channel 63 of the guided member 60 is set such that the separation distance between the first incline surface 64*a* of the inner peripheral wall 64 and the outer peripheral first concave surface 65*a* of the outer peripheral wall 65 is larger than the separation distance between the inner peripheral wall 64 and the outer peripheral wall 65 in the other part of the guiding channel 63. Therefore, even if there is an inaccuracy in the plate thickness of the lid 20 and the blocking member 12, etc., the coating member 32*a* coating the guided part 32 can be easily prevented from abutting against the outer peripheral wall 65 when the guided part 32 of the bearing bar 30 is located on the vertical line VL passing through the axis 02 of the shaft supported member 31 when the lid 20 is closed. As a result, the lid 20 can be revolved in the direction till the lid 20 is completely closed.

On the other hand, the guiding channel 63 is set such that the separation distance between the inner peripheral wall 64 except for the first incline surface 64*a* and the outer peripheral wall 65 except for the outer peripheral first concave surface 65*a* is smaller than the separation distance between the first incline surface 64*a* and the outer peripheral first concave surface 65*a*. Therefore, the guiding ability of the guided part 32 of the bearing bar 30 by the guiding channel 63 can be prevented from decreasing by setting the entire separation distance between the inner peripheral wall 64 and the outer peripheral wall 65 to be larger, and increasing the size of the guide body 62 can be avoided.

In addition, the guiding member 60 is mounted on a position where the lower end of the first incline surface 64*a* of the inner peripheral wall 64 is further backward than the vertical line VL passing through the axis 02 of the shaft supported member 31 of the support 30 at which the lid 20 is down. Further, the upper end of the first incline surface 64*a* of the inner peripheral wall 64 is more forward than the vertical line VL passing through the axis 02 of the shaft supported member 31 of the support 30 at which the lid 20 is down.

Moreover, since the guiding channel 63 is formed in a loop shape, the guided part 32 can be collided to the outer peripheral wall 65 of the guiding channel 63 while guiding, even when the guided part 32 of the bearing bar 30 is revolved largely by oscillating the keyboard instrumental 1 or revolving the lid 20 vigorously. Therefore, the guided part 32 can be prevented from dropping out of the guiding channel from a position between the inner peripheral wall 64 and the outer peripheral wall 65. As a result, the guided part 32 by the guiding channel 63 can be prevented from being unable to guide.

In addition, the guided part 32 of the bearing bar 30 is formed by bending the end part of the bearing bar 30 so that a center of gravity of the bearing bar 30 can be located on a side of the guided part 32 in which the shaft supported member 31 is supported on the lid 20. Moreover, the coating member 32*a* is coated only on the outer peripheral surface of the guided part 32, therefore, compared with a case in which the coating member 32*a* is coated on the outer peripheral surface of entire bearing bar 30, the weight of the guided part 32 can be increased, and the center of gravity of the bearing bar 30 can be located on the side of the guided part 32. Hence, gravity acting on the guided part 32 can be increased.

Moreover, the bearing bar 30 is composed of a metallic material; therefore, compared with a case that the bearing bar 30 is composed of a resin material which is lighter than the metallic material, etc., the gravity acting on the bearing bar 30 can be ensured. At the same time, miniaturizing the bearing bar 30 can be obtained. In addition, the guided part 32 of the bearing bar 30 guided to the guiding channel 63 of the guiding member 60 is coated on the coating member 32*a* composed of a resin material. Therefore, in case of which the bearing bar 30 collides with the inner peripheral wall 64 and the outer peripheral wall 65 of the guiding channel 63 when the guided part 32 is guided to the guiding channel 63, the bearing bar 30 allows the coating member 32*a* to collide with the inner peripheral wall 64 and the outer peripheral wall 65. Therefore, compared with a case of which a metal part of the bearing bar 30 collides with the inner peripheral wall 64 and the outer peripheral wall 65, noise generated during the colliding can be reduced. In addition, the coating member 32*a* is coated on the guided part 32; therefore, compared with a case of which the entire bearing bar 30 is coated on the coating member 32*a*, increasing the size of the entire bearing bar 30 can be prevented, and a material cost of a resin material used for the coating member 32*a* can be reduced.

Figure 7:
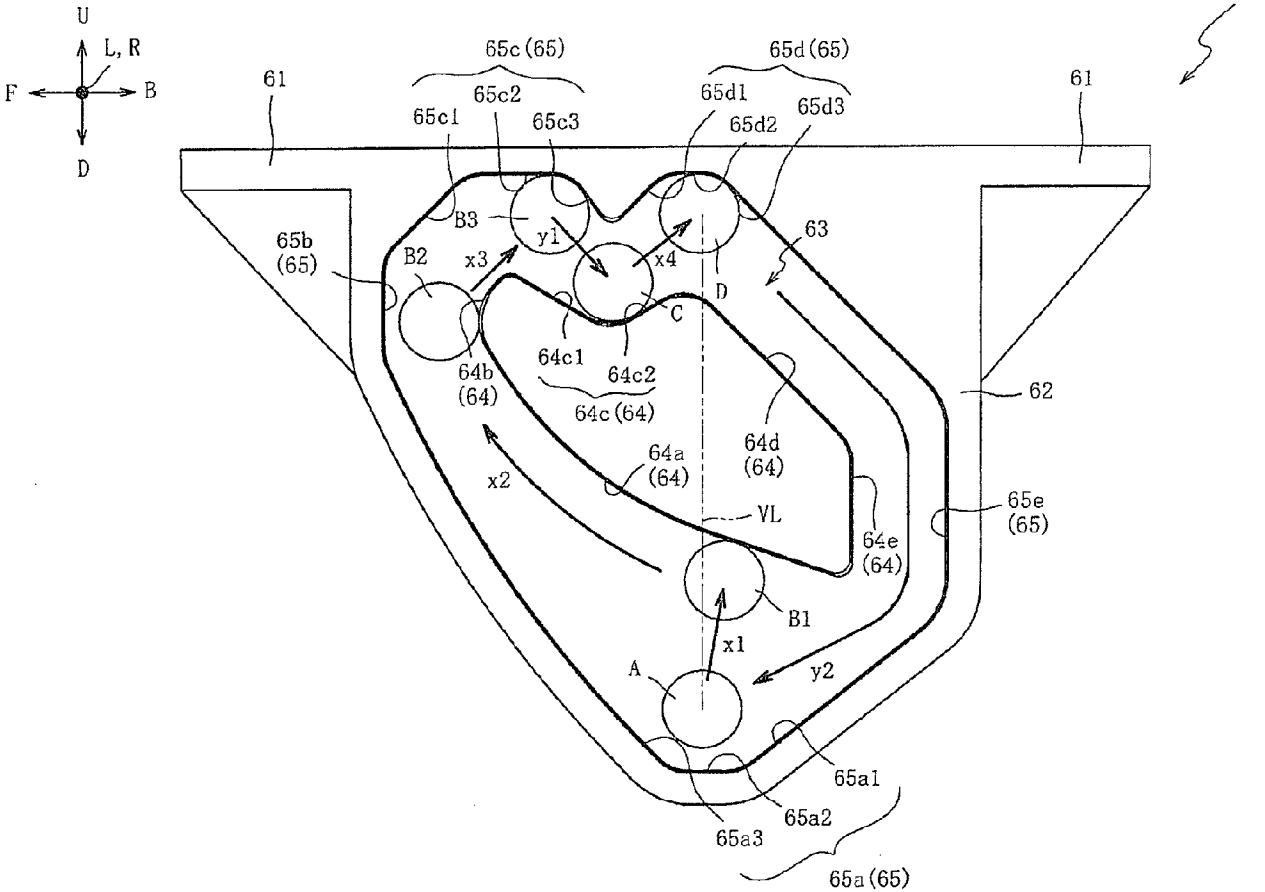
FIG. 7 is a schematic view schematically illustrated a movement aspect of a guided part of the bearing bar guided to a guiding channel.

Next, referring to FIG. 6 and FIG. 7, a movement aspect of the guided part 32 of the bearing bar 30 according to a revolving operation of the lid 20 is described. FIG. 6 is a partial side view of the keyboard instrument 1 of which the lid 20 is opened. FIG. 7 is a schematic view schematically illustrated the movement aspect of the guided part 32 of the bearing bar 30 guided to the guiding channel 63. Besides, in order to simplify the drawing and allow easier understanding, the side plate on a right side of the support 11 of the keyboard instrument 1 is not shown, and the bearing bar 30 and the lid unit 100 in a state of the lid 20 being down are shown with a dashed line in FIG. 6. In addition, positions A-D in FIG. 7 schematically shows the positions of the guided part 32 of the bearing bar 30, which moves according to the revolving operation of the lid 20.

As shown in FIG. 6 and FIG. 7, when the lid 20 is revolved in an X direction (direction to make the lid 20 to be opened, that is, upward and backward) from a state of being down, the guided part 32 of the bearing bar 30 is guided to the guiding channel 63 of the guiding member 60 while moving to the inner peripheral concave surface 64*c* of the inner peripheral wall 64 of the guiding channel 63. Further, through the restraining of the movement in a front-back direction and downward of the guided part 32 by the inner peripheral concave surface 64*c*, the lid 20 is supported by the bearing bar 30, and the lid 20 can be maintained being opened.

In addition, when the lid 20 is revolved further in the X direction from the state of being opened, the guided part 32 of the bearing bar 30 is guided to the guiding channel 63 of the guiding member 60 while moving between the first incline surface 64*a* of the inner peripheral wall 64 and the outer peripheral first concave surface 65*a* of the outer peripheral wall 65 of the guiding channel 63. The lid 20 is moved from a state of being down through the support abutting part 22 of the lid 20 (see in FIG. 4) abutted on the support 11.

Specifically, since the shaft supported member 31 of the bearing bar 30 is supported by the lid 20, the guided part 32 of the bearing bar 30 is revolved like a pendulum with the axis 02 of the shaft supported member 31 as a revolving center. Further, the guided part 32 has a tendency to locate on the vertical line VL passing through the axis 02 of the shaft supported member 31 due to gravity. That is, in a state that the lid 20 is closed, the guided part 32 attempts to locate at a position A on the vertical line VL passing through the axis 02 of the shaft supported member 31. Besides, in the description below, it is assumed that the guided part 32 of the bearing bar 30 is located at the position A in a state that the lid 20 is closed.

When the lid 20 is revolved in the X direction with the axis 01 as a revolving center from the state in which the guided part 32 of the bearing bar 30 is located at the position A, that is, the lid 20 is down, the shaft supported member 31 of the bearing bar 30 supported by the lid 20 moves in the X direction according to the revolution of the lid 20. Herein, the guided part 32 has a tendency to locate on the vertical line VL passing through the axis 02 of the shaft supported member 31. Therefore the guided part 32 moves along an x1 direction parallel to the X direction according to the movement of the shaft supported member 31, and reaches a position B1.

In a state in which the guided part 32 reaches the position B1, that is, a state in which the guided part 32 abuts on the first incline surface 64*a* of an inner peripheral wall 64, the first incline surface 64*a* inclines upward as it moves forward. Therefore, the backward movement of the guided part 32 located on the position B1 is restrained. Hence, the guided part 32 slides on the first incline surface 64*a* while being guided upward and forward (x2 direction), and reaches the position B2.

Besides, the lower end of the first incline surface 64*a* is located on further backward than the position A, and the upper end thereof is located on further forward than the position A. Therefore, it is certain that the guided part 32 located on the position A is abutted on the first incline surface 64*a*.

In a state in which the guided part 32 reaches the position B2, that is, a state in which the guided part 32 abuts on the first incline surface 64*a* and the guidance by the first incline surface 64*a* is completed, the restraining for the backward movement of the guided part 32 by the first incline surface 64*a* is aborted. At this time, the guided part 32 has a tendency to be located more forward than the shaft supported member 31, and has a tendency to locate on the vertical line VL passing through the axis 02 of the shaft supported member 31 due to gravity. Accordingly, when the guided part 32 passes over the upper end of the first incline surface 64*a*, the guided part 32 slides on the second incline surface 64*b* while being guided upward and backward (x3 direction), and reaches the position B3.

When the guided part 32 reaches the position B3, the guided part 32 abuts on the later mentioned concave surfaces of the outer peripheral second concave surface 65*c* of the outer peripheral wall 65, i.e. the peripheral second horizontal concave surface 65*c*2 and the outer peripheral second downward facing inclined concave surface 65*c*3. The outer peripheral second horizontal concave surface 65*c*2 extends horizontally in the front-back direction. The outer peripheral second downward facing inclined concave surface 65*c*3 inclines downward as it moves backward. The movement in the x3 direction the guided part 32 is restrained. At this time, the guided part 32 is engaged with the outer peripheral second horizontal concave surface 65*c*2 and the outer peripheral second downward facing inclined concave surface 65*c*3; therefore, the revolution in the X direction of the lid 20 is restrained. In this case, the lid 20 is revolved in a Y direction continuously (a direction to lay the lid 20 down, that is, downward and forward).

Besides, in a state that the guided part 32 reaches the position B3, the guided part 32 of the bearing bar 30 is located further forward than the vertical line VL passing through the axis 02 of the shaft supported member 31 when the lid 20 is down. In contrast, the shaft supported member 31 is located further backward than the vertical line VL passing through the axis 02 of the shaft supported member 31 when the lid 20 is down. Therefore, by revolving the lid 20 in the Y direction, the shaft supported member 31 of the bearing bar 30 moves downward and forward. In contrast, the guided part 32 has a tendency to locate below the vertical line passing through the axis 02 of the shaft supported member 31, thus the guided part 32 moves downward and backward. As a result, the guided part 32 moves in y1 direction, and reaches a position C.

In a state in which the guided part 32 reaches the position C, that is, a state in which the guided part 32 abuts on the inner peripheral downward facing inclined concave surface 64*c*1 and the inner peripheral upward facing inclined concave surface 64*c*2 of the inner peripheral concave surface 64*c* of the inner peripheral wall 64, the guided part 32 is engaged with the inner peripheral downward facing inclined concave surface 64*c*1 and the inner peripheral upward facing inclined concave surface 64*c*2; therefore, the movements of the guided part 32 in the front-back direction and the downward direction is restrained. Accordingly, the movement of the lid 20 along the Y direction is restrained. By finishing the revolving operation of the lid 20, the lid 20 can be supported by the bearing bar 30, and the lid 20 is maintained being opened.

Thus, by the revolving operation of the lid 20, without operating the bearing bar 30, the lid 20 can be changed from a close state to an open state. Therefore, the operation for adjusting the lid 20 from the close state to the open state can be simplified.

Moreover, by revolving the lid 20 in the X direction to a position where the revolution is restrained from the state in which the lid 20 is closed and revolving the lid 20 in the Y direction after the revolution of the lid 20 in the X direction is restrained, the lid 20 can be changed to an open state, therefore, the complicated revolving operation of the lid 20 for engaging the guided part 32 of the bearing bar 30 with the inner peripheral concave surface 64*c* can be unnecessary. Therefore, the operability when adjusting the lid 20 from the close state to the open state can be improved.

In addition, in an open state of the lid 20, that is, a state in which the guided part 32 of the bearing bar 30 is engaged with the inner peripheral concave surface 64*c*, the guided part 32 is located further forward than the vertical line VL passing through the shaft supported member 31 in a state that the lid 20 is down. In contrast, the shaft supported member 31 is located further backward than the vertical line VL passing through the shaft supported member 31 in a state that the lid 20 is down. Accordingly, the guided part 32 of the bearing bar 30 is engaged with the inner peripheral concave surface 64*c* in front of the shaft supported member 31; therefore, the lid 20 can be supported by the bearing bar 30 in a state in which a line connecting the shaft supported member 31 and the guided part 32 of the bearing bar 30 (axis direction of the connecting part 33) is arranged along the Y direction, which is in for laying down the lid 20. Therefore, the lid 20 can be stably supported by the bearing bar 30.

Herein, in an open state of the lid 20, it is preferred to set an angle formed by the connecting part 33 of the bearing bar 30 and the lower surface side of the lid 20 to be between 70 and 110 degrees. Accordingly, the lid 20 can be supported more stably by the bearing bar 30. Besides, the angle formed by the connecting part 33 of the bearing bar 30 and the lower surface side of the lid 20 can be set by adjusting a relative position in a front-back direction between the insertion channel 52 of the shaft-supporting member 50 mounted on the lid 20 and the inner peripheral concave surface 64*c* of the guiding member 60 mounted on the blocking member 12, and adjusting the length along the axis of the connecting part 33 of the bearing bar 30.

When the lid 20 is revolved further in the X direction from the state that the guided part 32 reaches the position C, which is the state that the guided part 32 is engaged with the inner peripheral concave surface 64*c*, the guided part 32 moves upward and backward (x4 direction) and reaches a position D. Hereby, the guided part 32 is disengaged from the inner peripheral concave surface 64*c*.

When the guided part 32 reaches the position D, the guided part 32 abuts on the later mentioned concave surfaces of the outer peripheral third concave surface 65*d* of the outer peripheral wall 65, i.e. the outer peripheral third horizontal concave surface 65*d*2 and the outer peripheral third downward facing inclined concave surface 65*d*3. The outer peripheral third horizontal concave surface 65*d*2 extends horizontally in the front-back direction. The outer peripheral third downward facing inclined concave surface 65*d*3 inclines downward as it goes backward. The movement in the x4 direction of the guided part 32 is restrained. At this time, the guided part 32 is engaged with the outer peripheral third horizontal concave surface 65*d*2 and the outer peripheral third downward facing inclined concave surface 65*d*3; therefore, the revolution in the X direction of the lid 20 is restrained. In this case, the lid 20 is revolved continuously in the Y direction.

Hereby, the guided part 32 is guided by the third incline surface 64*d* and the inner peripheral vertical surface 64*e* of the inner peripheral wall 64 and by the outer peripheral third downward facing inclined concave surface 65*d*3 and the outer peripheral second vertical surface 65*e* of the outer peripheral wall 65 while moving downward (y2 direction). The guided part 32 is also guided between the first incline surface 64*a* of the inner peripheral wall 64 and the outer peripheral first concave surface 65*a* of the outer peripheral wall 65, and reaches the position A. In addition, the support abutting part 22 is abutted on the upper part of the support 11, and the lid 20 is completely closed.

Besides, in a case which the outer peripheral second horizontal concave surface 65*c*2 and the outer peripheral third horizontal concave surface 65*d*2 are omitted on the outer peripheral second concave surface 65*c* and the outer peripheral third concave surface 65*d*, the position B3 indicates that the guided part 32 is abutted on the outer peripheral second upward facing inclined concave surface 65*c*1 and the outer peripheral second downward facing inclined concave surface 65*c*3, and the position D indicates that the guided part 32 is abutted on the outer peripheral third upward facing inclined concave surface 65*d*1 and the outer peripheral third downward facing inclined concave surface 65*d*3.

Thus, by performing only the revolving operation of the lid 20, without operating the bearing bar 30, the lid 20 can be adjusted from being up in an open state to being down in a close state; therefore, the operation for adjusting the lid 20 from the open state to the close state can be simplified.

Moreover, the lid 20 can be closed by revolving the lid 20 further in the X direction from the open state and then revolving the lid 20 in the Y direction after the revolution of the lid 20 in the X direction is restrained. Therefore, the complicated revolving operation of the lid 20 is obviated, and the operability of adjusting the lid 20 to the close state can be improved.

Herein, regarding the outer peripheral third concave surface 65*d*, a connecting point of the outer peripheral third horizontal concave surface 65*d*2 and the outer peripheral third downward facing inclined concave surface 65*d*3 of the outer peripheral third concave surface 65*d* is preferably formed within a range. The range is from the connecting point of the inner peripheral downward facing inclined concave surface 64*c*1 and the inner peripheral upward facing inclined concave surface 64*c*2 of the inner peripheral concave surface 64*c* backwardly in a distance of two times of the outer diameter of the bearing bar 30. Hereby, comparing the former arrangement of the outer peripheral third concave surface 65*d* with an arrangement that is positioned much more backwardly, the amount of the revolving operation of the lid 20 in the X direction in the former can be reduced when adjusting the lid 20 from the open state to the closed state.

In addition, it is preferred that the outer peripheral third concave surface 65*d* is configured that the guided part 32 is abutted on the outer peripheral third horizontal concave surface 65*d*2 and the outer peripheral third downward facing inclined concave surface 65*d*3 of the outer peripheral third concave surface 65*d* when revolving the lid 20 at most five degrees from the open state in the X direction of further opening the lid 20, that is, the guided part 32 of the bearing bar 30 is located on the position C. Compared the former configuration of the outer peripheral third concave surface 65*d* with a case that the guided part 32 is engaged with the outer peripheral third concave surface 65*d* by revolving the lid 20 further in the X direction by more than five degrees from the open state, the amount of the revolving operation in the X direction of the lid 20 in the former arrangement when adjusting the lid 20 to the close state can be reduced.

Besides, the revolution in the Y direction of the lid 20 includes not only the lid 20 being supported while revolving the lid 20 in the Y direction, but also includes the lid 20 being revolved in the Y direction by releasing the lid 20 from a hand and using gravitational force on the lid 20.

In addition, the second concave surface is "located on a side further away from the first axis than the first concave surface" in claim 4 indicates that the connecting part of the outer peripheral second horizontal concave surface 65*c*2 and the outer peripheral second downward facing inclined concave surface 65*c*3 of the outer peripheral second concave surface 65*c* is located further forward than the connecting part of the inner peripheral downward facing inclined concave surface 64*c*1 and the inner peripheral upward facing inclined concave surface 64*c*2 of the inner peripheral concave surface 64*c* in the embodiment.

Moreover, the third concave surface is "located on a side closer to the first axis than the first concave surface" in Claim 5 and Claim 6 indicates that the connecting part of the outer peripheral third horizontal concave surface 65*d*2 and the outer peripheral third downward facing inclined concave surface 65*d*3 of the outer peripheral third concave surface 65*d* is located further backward than the connecting part of the inner peripheral downward facing inclined concave surface 64*c*1 and the inner peripheral upward facing inclined concave surface 64*c*2 of the inner peripheral concave surface 64*c* in the embodiment.

As described above, by the revolving operation of the lid 20, without operating the bearing bar 30, the lid 20 can be adjusted to be opened or closed; therefore, the operation for adjusting the lid 20 to the open state or the close state can be simplified. As a result, since it is not necessary to operate the lid 20 by one hand while operating the bearing bar 30 by the other hand, a risk of pinching the other hand between the lid 20 and the musical instrument body 10 can be prevented.

In addition, the bearing bar 30 is composed of a metallic material and can increase the gravity acting on the guided part 32 by coating the coating member 32*a* only on the guided part 32 formed by bending the end part. Accordingly, the gravity acting on the guided part 32 can be effectively used when the guided part 32 is guided by the guiding channel 63 of the guiding member 60; therefore, the guided part 32 can be smoothly guided to the guiding channel 63.

Moreover, since the coating member 32*a* made of a resin is coated on the guided part 32, the coefficient of friction between the guided part 32 and the inner peripheral wall 64 and the outer peripheral wall 65 when the guided part 32 is guided and slid on the inner peripheral wall 64 and the outer peripheral wall 65 of the guiding channel 63 can be decreased. Accordingly, the guided part 32 slide better in the guiding channel 63; therefore, the guiding ability of the guided part 32 by the guiding channel 63 can be improved.

Next, referring to FIGS. 8A and 8B to FIG. 13, a second embodiment is described. The open state of the lid 20 is maintained through the engagement of the guided part 32 of the bearing bar 30 and the inner peripheral concave surface 64*c* of the inner peripheral wall 64 of the guiding channel 63 in the first embodiment. The open state of the lid 20 is maintained through the engagement of the guided part 32 of the bearing bar 30 and an inner peripheral first concave surface 264*c* or an inner peripheral second concave surface 264*d* of an inner peripheral wall 264 of a guiding channel 263 in the second embodiment. Besides, the same reference numbers are used for the same parts as the above-mentioned first embodiment, and explanation thereof is omitted.

Figure 8B:
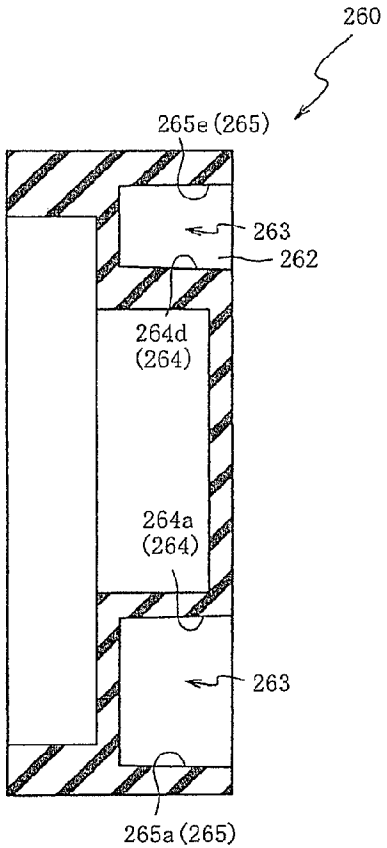
FIG. 8B is a cross section of the guiding member along VIIIb-VIIIb in FIG. 8A.
Figure 8A:
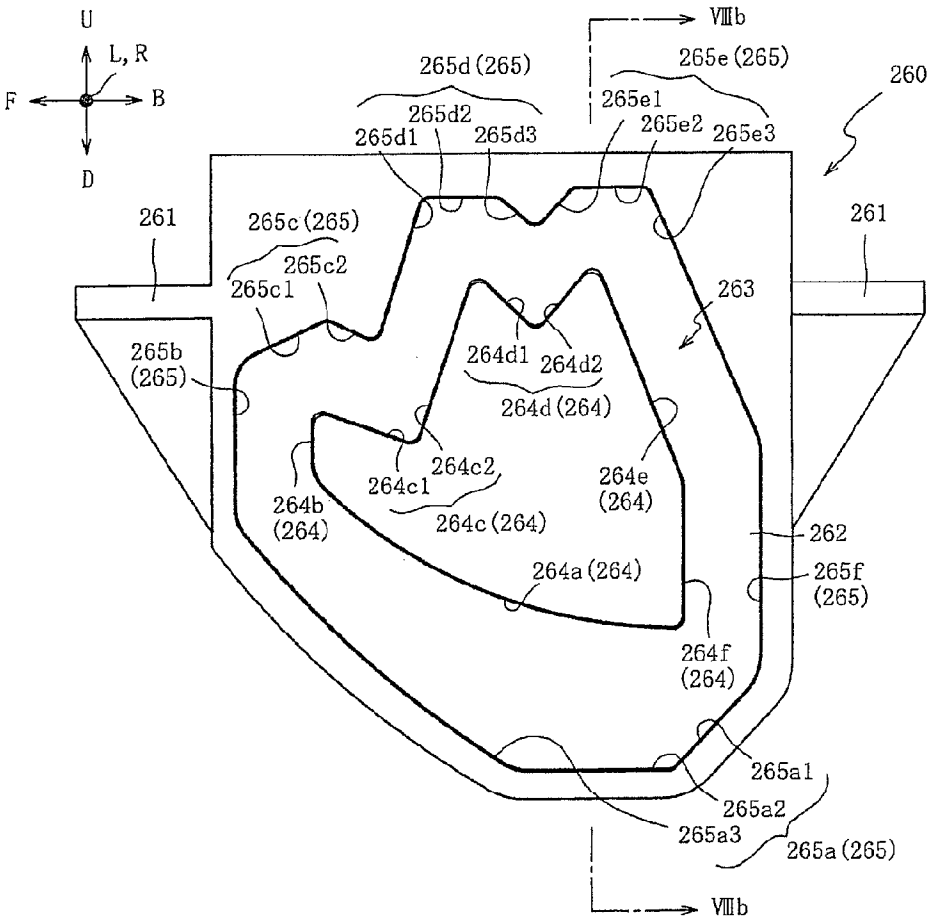
FIG. 8A is a front view of a guiding member of a keyboard instrument according to a second embodiment of the invention.
Figure 9:
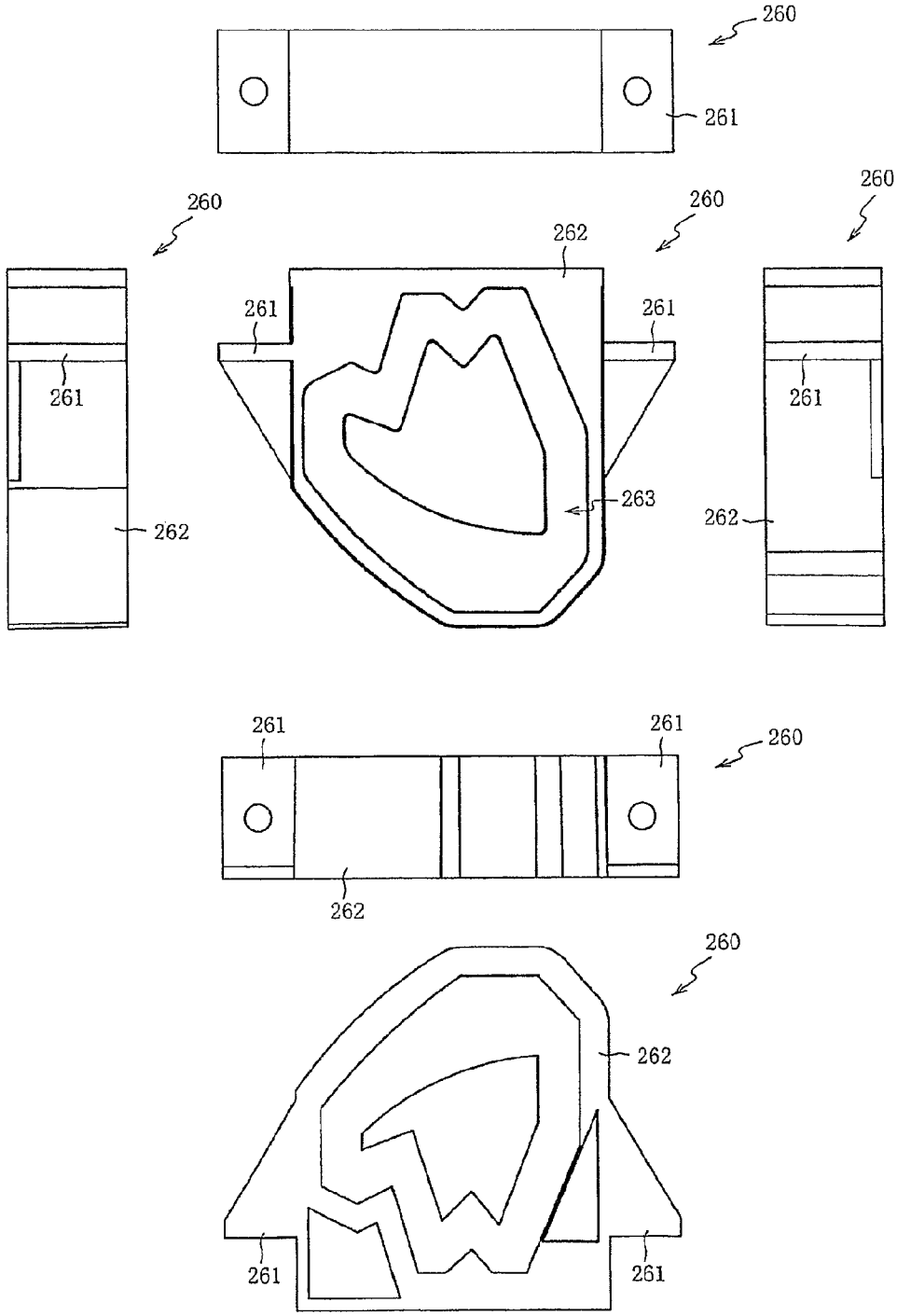
FIG. 9 is six views of the guiding member.

First, referring to FIGS. 8A and 8B and FIG. 9, a guiding member 260 of a keyboard instrument 201 (see FIG. 10) in the second embodiment is described. FIG. 8A is a front view of the guiding member 260 of the keyboard instrument 201 according to the second embodiment of the invention, and FIG. 8B is a cross section of the guiding member 260 along VIIIb-VIIIb in FIG. 8A. FIG. 9 is six views of the guiding member 260.

As shown in FIGS. 8A and 8B and FIG. 9, the guiding member 260 is a member made of a resin for guiding the guided part 32 of the bearing bar 30, and includes a pair of guiding mounting parts 261 in a plate shape, a guide body 262 formed between a pair of the guiding mounting parts 261 and the loop-shaped guiding channel 263 recessed on one surface side of the guide body 262.

The guiding channel 263 includes the inner peripheral wall 264 forming an inner peripheral of the guiding channel 263, and an outer peripheral wall 265 disposed on a position facing the inner peripheral wall 264 and configuring an outer peripheral of the guiding channel 263.

The inner peripheral wall 264 includes a first incline surface 264*a* inclining upward as it extends forward, an inner peripheral first vertical surface 264*b* connected to an upper end of the first incline surface 264*a* and extended upward, the inner peripheral first concave surface 264*c* in a valley shape located further backward than the inner peripheral first vertical surface 264*b* and connected to an upper end of the inner peripheral vertical surface 264*b* and recessed downward, the inner peripheral second concave surface 264*d* in a valley shape located further upward and backward than the inner peripheral first concave surface 264*c* and connected to a back end of the inner peripheral first concave surface 264*c* and recessed downward, a second incline surface 264*e* connected to a back end of the inner peripheral second concave surface 264*d* and inclining downward as it goes backward, and an inner peripheral second vertical surface 264*f* connecting a lower end of the second incline surface 264*e* and a lower end of the first incline surface 264*a* and extended along an up-down direction.

The inner peripheral first concave surface 264*c* includes an inner peripheral first downward facing inclined concave surface 264*c*1 inclining downward as it extends backward, and an inner peripheral second upward facing inclined concave surface 264*c*2 connected to a lower end of the inner peripheral first downward facing inclined concave surface 264*c*1 and inclining upward as it extends backward. The inner peripheral second concave surface 264*d* includes an inner peripheral second downward facing inclined concave surface 264*d*1 inclining downward as it extends backward, and an inner peripheral second upward facing inclined concave surface 264*d*2 connected to a lower end of the inner peripheral second downward facing inclined concave surface 264*d*1 and inclining upward as it extends backward.

The outer peripheral wall 265 includes an outer peripheral first concave surface 265*a* disposed facing to the first incline surface 264*a*, an outer peripheral first vertical surface 265*b* connected to a front end of the outer peripheral first concave surface 265*a* and extended upward, an outer peripheral second concave surface 265*c* in a valley shape located further backward than the outer peripheral first vertical surface 265*b* and connected to an upper end of the outer peripheral first vertical surface 265*b* and recessed upward, an outer peripheral third concave surface 265*d* in a valley shape located further backward and upward than the outer peripheral second concave surface 265*c* and connected to a back end of the outer peripheral second concave surface 265*c* and recessed upward, an outer peripheral fourth concave surface 265*e* in a valley shape located further backward than the outer peripheral third concave surface 265*d* and connected to a back end of the outer peripheral third concave surface 265*d* and recessed upward, and an outer peripheral second vertical surface 265*f* connecting a back end of the outer peripheral third concave surface 265*d* and a back end of the outer peripheral second vertical surface 265*e* and a back end of the outer peripheral first concave surface 265*a* and extended along an up-down direction.

The outer peripheral first concave surface 265*a* includes an outer peripheral first downward facing inclined concave surface 265*a*1 inclining downward as it goes forward, and an outer peripheral first horizontal concave surface 265*a*2 connected to a lower end of the outer peripheral first downward facing inclined concave surface 265*a*1 and extended horizontally forward, and an outer peripheral first upward facing inclined concave surface 265*a*3 connected to a front end of the outer peripheral first horizontal concave surface 265*a*2 and inclining upward as it extends forward. The outer peripheral second concave surface 265*c* includes an outer peripheral second upward facing inclined concave surface 265*c*1 inclining upward as it extends backward, an outer peripheral second downward facing inclined concave surface 265*c*2 connected to an upper end of the outer peripheral second upward facing inclined concave surface 265*c*1 and inclining downward as it extends backward. The outer peripheral third concave surface 265*d* includes an outer peripheral third upward facing inclined concave surface 265*d*1 inclining upward as it extends backward, an outer peripheral third horizontal concave surface 265*d*2 connected to an upper end of the outer peripheral third upward facing inclined concave surface 265*d*1 and extended horizontally backward, and an outer peripheral third downward facing inclined concave surface 265*d*3 connected to a back end of the outer peripheral third horizontal concave surface 265*d*2 and inclining downward as it extends backward. The outer peripheral fourth concave surface 265*e* includes an outer peripheral fourth upward facing inclined concave surface 265*e*1 inclining upward as it extends backward, an outer peripheral fourth horizontal concave surface 265*e*2 connected to an upper end of the outer peripheral fourth upward facing inclined concave surface 265*e*1 and extended horizontally backward, and an outer peripheral fourth downward facing inclined concave surface

265*e*3 connected to a back end of the outer peripheral fourth horizontal concave surface 265*e*2 and inclining downward as it extends backward.

The guiding channel 263 is configured such that separation distances between surfaces of the inner peripheral wall 264 and the outer peripheral wall 265 are approximately the same, except for the first incline surface 264*a* and the outer peripheral first concave surface 265*a*. A separation distance between the first incline surface 264*a* and the outer peripheral first concave surface 265*a* is larger than the separation distance between the inner peripheral wall 264 and the outer peripheral wall 265 in the other part of the guiding channel 263.

The upper end of the first incline surface 264*a* and a front end of the inner peripheral first concave surface 264*c* in the inner peripheral wall 264 are connected through the inner peripheral first vertical surface 264*b* extended along an up-down direction, and the lower end of the second incline surface 264*e* and the lower end of the first incline surface 264*a* are connected through the inner peripheral second vertical surface 264*f* extended along an up-down direction. Therefore, compared with a case that the upper end of the first incline surface 264*a* and the front end of the inner peripheral first concave surface 264*c* are directly connected or a case that the lower end of the second incline surface 264*e* and the lower end of the first incline surface 264*a* are directly connected, the strength of a connection part of the upper end of the first incline surface 264*a* and the front end of the inner peripheral first concave surface 264*c* and a connection part of the lower end of the second incline surface 264*e* and the lower end of the first incline surface 264*a* can be ensured. Further, the size of the front or the back side of the guide body 262 can be reduced.

Moreover, the front end of the outer peripheral first concave surface 265*a* and a front end of the outer peripheral second concave surface 265*c* of the outer peripheral wall 265 are connected through the outer peripheral first vertical surface 265*b* extended along an up-down direction, and the back end of the outer peripheral fourth concave surface 265*e* and the back end of the outer peripheral first concave surface 265*a* are connected through the outer peripheral second vertical surface 265*f* extended along an up-down direction. Therefore, compared with a case that the front end of the outer peripheral first concave surface 265*a* and the front end of the outer peripheral second concave surface 265*c* are directly connected or a case that the back end of the outer peripheral fourth concave surface 265*e* and the back end of the outer peripheral first concave surface 265*a* are directly connected, the protrusion size toward a the front or the back side of the outer peripheral wall 265 can be reduced; as a result, the size of the front or the back side of the guide body 262 can be reduced.

Similarly, through the outer peripheral first concave surface 265*a*, the outer peripheral third concave surface 265*d* and the outer peripheral fourth concave surface 265*e* of the outer peripheral wall 265 include the outer peripheral first horizontal concave surface 265*a*2, the outer peripheral third horizontal concave surface 265*d*2 and the outer peripheral fourth horizontal concave surface 265*e*2 extended along front-back directions respectively; the size of the guided body 262 in the up-down direction can be reduced.

Figure 10:
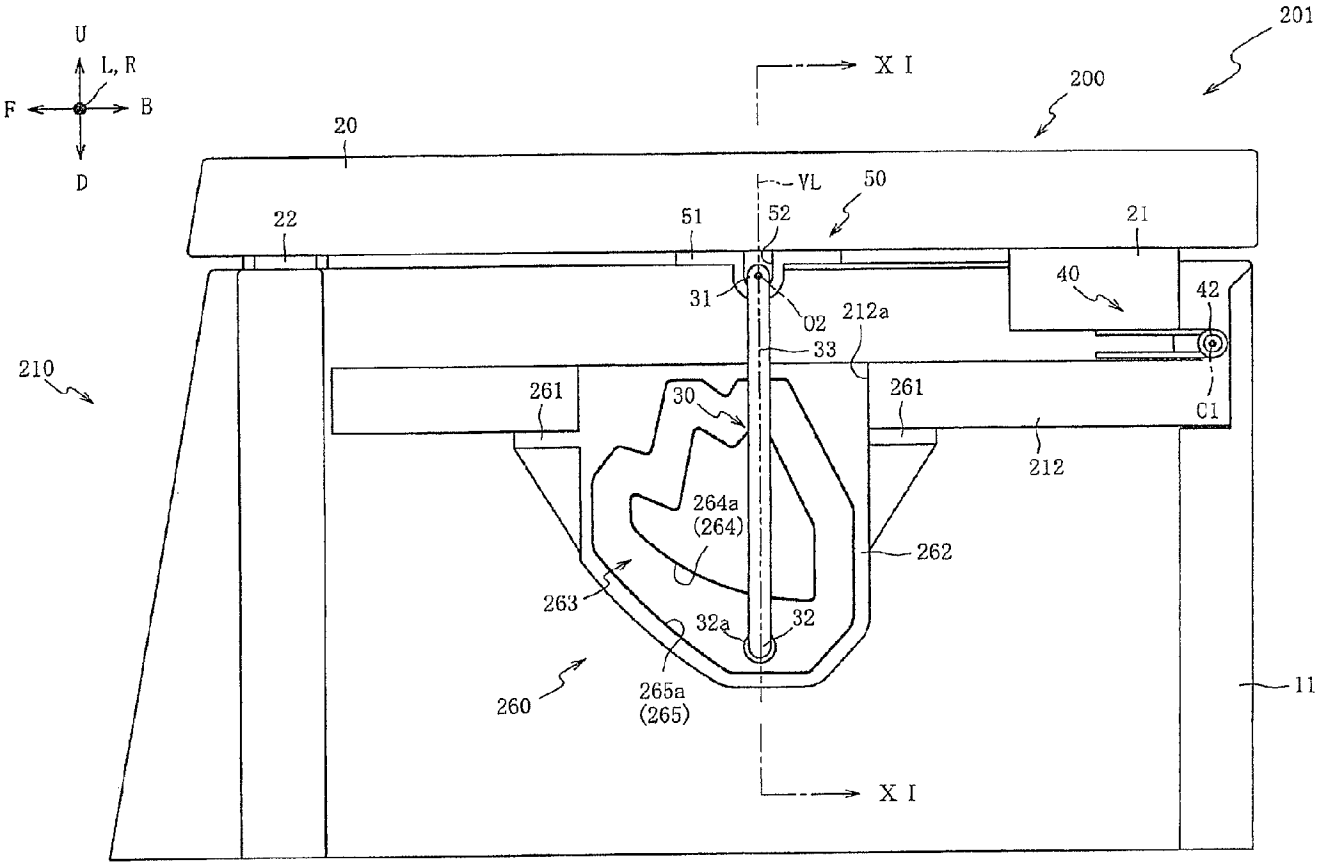
FIG. 10 is a partial side view of the keyboard instrument in a state in which a lid is closed.
Figure 11:
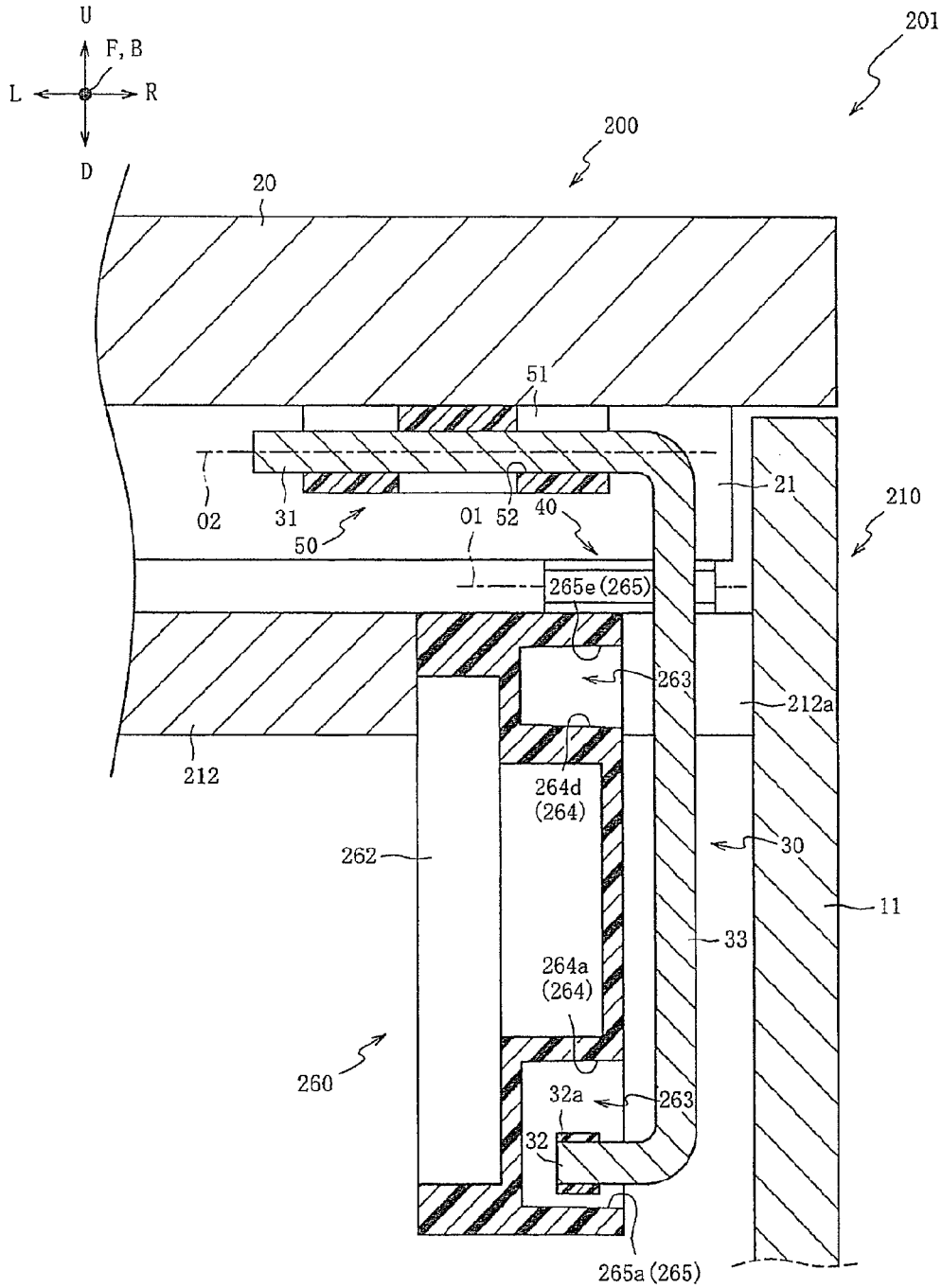
FIG. 11 is a cross section of the keyboard instrument along XI-XI line in FIG. 10.

Next, referring to FIG. 10 and FIG. 11, an assembling method of the bearing bar 30 and a lid unit 200 to the support 11 in a musical instrument body 210 is described. FIG. 10 is a partial side view of the keyboard instrument 201 with the lid 20 in a state of being down. FIG. 11 is a cross section of the keyboard instrument 201 along XI-XI line in FIG. 10. Besides, in order to simplify the drawing and facilitate understanding, a side plate on the right side of the support 11 of the keyboard instrument 201 is not shown in FIG. 10, and the side plate on the right side of the support 11 is shown in FIG. 11.

As shown in FIG. 10 and FIG. 11, a blocking member 212 is a board-shaped member made of wood, wherein a notch 212*a* is a recess at the left or right side of the blocking member 212. In addition, the lid 20 is supported on an upper surface side of the blocking member 212 in a rotatable manner rotating with the axis 01 of the shaft member 42 of the hinge 40 as a revolving center through which the lid 20 is disposed facing thereto and the lid 20 is connected by the hinge 40. On the other hand, the guiding member 260 is mounted on a lower surface side of the blocking member 212.

Herein, the guiding mounting parts 261 is mounted on the guiding member 260 by a bolt (not shown) under such a configuration that the guiding channel 263 faces outwardly along the left-right direction while storing an upper part of the guiding mounting parts 261 of the guide body 262 in the inside of the notch 212*a* of the blocking member 212. Hereby, through a surface opposite to the guiding channel 263 on the upper part of the guide body 262 (surface on the left side of the guide body 262 in FIG. 11), the guide body 262 is abutted on an inner peripheral surface of the notch 212*a* (wall surface on the left side of the notch 212*a* in FIG. 11). The guiding mounting part 261 is mounted on the lower surface side of the blocking member 212. Thus, the positioning of the guiding member 260 with respect to the blocking member 212 along the left-right direction can be performed easily.

Moreover, by setting a distance from an upper surface of the guiding mounting parts 261 to an upper surface of the guide body 262 along the up-down direction to be the same as a plate thickness of the blocking member 212, the upper surface of the guide body 262 and the upper surface of the blocking member 212 can be coplanar in a state in which the guiding member 260 is mounted on the blocking member 212. Therefore, compared with a case in which the upper surface of the guide body 262 and the upper surface of the blocking member 212 are in a step shape, the appearance of the upper surface side of the blocking member 212 can be better and cleaning the upper surface side of the blocking member 212 can be easier.

In addition, through the lid 20 and the guiding member 260 are mounted on the blocking member 212, the lid 20, the blocking member 212 and the guiding member 260 are configured as one lid unit 200, Therefore, by inserting the shaft supported member 31 of the bearing bar 30 into the insertion channel 52 of the shaft-supporting member 50, the lower surface of the lid 20 and the upper surface of the blocking member 212, which is connected by the hinge 40, opposite to the lower surface side of the lid 20 are parallel and face each other. The guided part 32 of the bearing bar 30 is disposed between the inner peripheral wall 264 and the outer peripheral wall 265 of the guiding channel 263 in the guiding member 260, and the connecting part 33 of the bearing bar 30 is disposed inside the notch 212*a* of the blocking member 212.

Next, in the lid unit 200, the blocking member 212 is mounted on the support 11 by using a bolt or a support fitting (not shown) in a state in which the bearing bar 30 is supported on the lid 20.

At this time, in the support 30, the shaft supported member 31 is supported on the lid 20 in a rotatable manner in which the connecting part 33 is inserted into the inside of the notch 212*a* of the blocking member 212, and when the lower surface of the lid 20 and the upper surface of the blocking member 212 are parallel and face each other, the guided part 32 of the support 30 is located between the first incline surface 264*a* of the inner peripheral wall 264 and the outer peripheral first concave surface 265*a* of the outer peripheral wall 265 of the guiding member 260.

In addition, the lower end of the first incline surface 264*a* of the inner peripheral wall 264 is mounted on a position which is further backward than the vertical line VL passing through the axis 02 of the shaft supported member 31 of the support 30 when the lid 20 is down. Further, the upper end of the first incline surface 264*a* of the inner peripheral wall 264 is mounted on a position which is further forward than the vertical line VL passing through the axis 02 of the shaft supported member 31 of the support 30 in a state when the lid 20 is down.

The guiding channel 263 of the guided member 260 is set such that the separation distance between the first incline surface 264*a* of the inner peripheral wall 264 and the outer peripheral first concave surface 265*a* of the outer peripheral wall 265 is larger than the separation distance between the inner peripheral wall 264 and the outer peripheral wall 265 in the other part of the guiding channel 263. Therefore, even if there is an error in the plate thicknesses of the lid 20 and the blocking member 212, the coating member 32*a* coating the guided part 32 of the bearing bar 30 can be prevented from abutting on the outer peripheral first concave surface 265*a* of the outer peripheral wall 265. As a result, the lid 20 can revolve in a direction to lay the lid 20 down and as far as possible to a position in which the lid 20 is down completely.

On the other hand, the guiding channel 263 is set such that the separation distance between the inner peripheral wall 264 except for the first incline surface 264*a* and the outer peripheral wall 265 except for the outer peripheral first concave surface 265*a* is smaller than the separation distance between the first incline surface 264*a* and the outer peripheral first concave surface 265*a*. Therefore, increasing the entire separation distance between the inner peripheral wall 264 and the outer peripheral wall 265 can be restrained. Further, decreasing the guiding ability of the guided part 32 of the bearing bar 30 by the guiding channel 263 can be avoided, while increasing the size of the guide body 262 can be prevented.

Figure 12A:
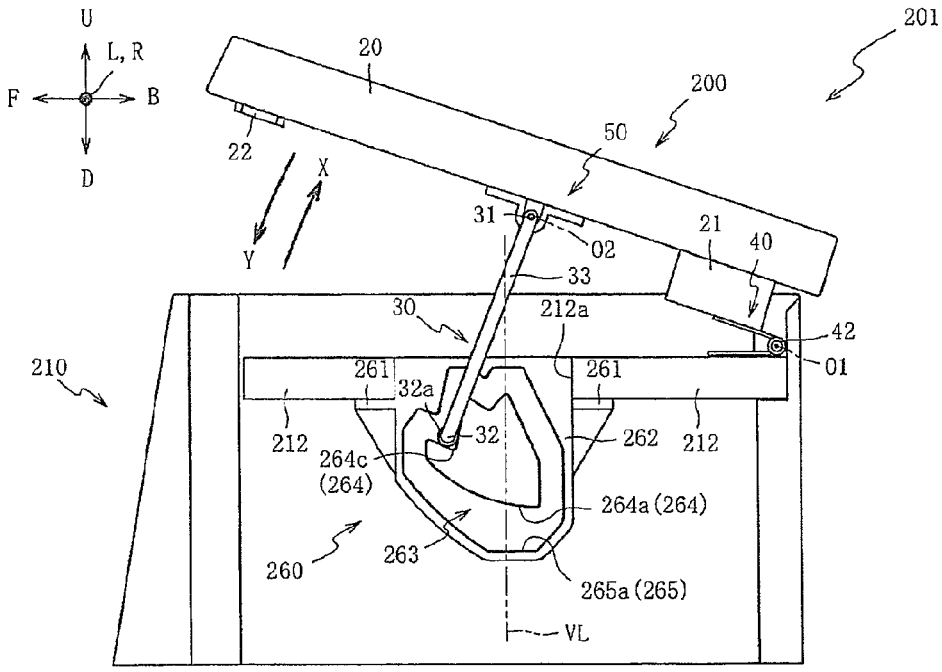
FIG. 12A and FIG. 12B are partial side views of the keyboard instrument in a state in which the lid is opened.
Figure 12B:
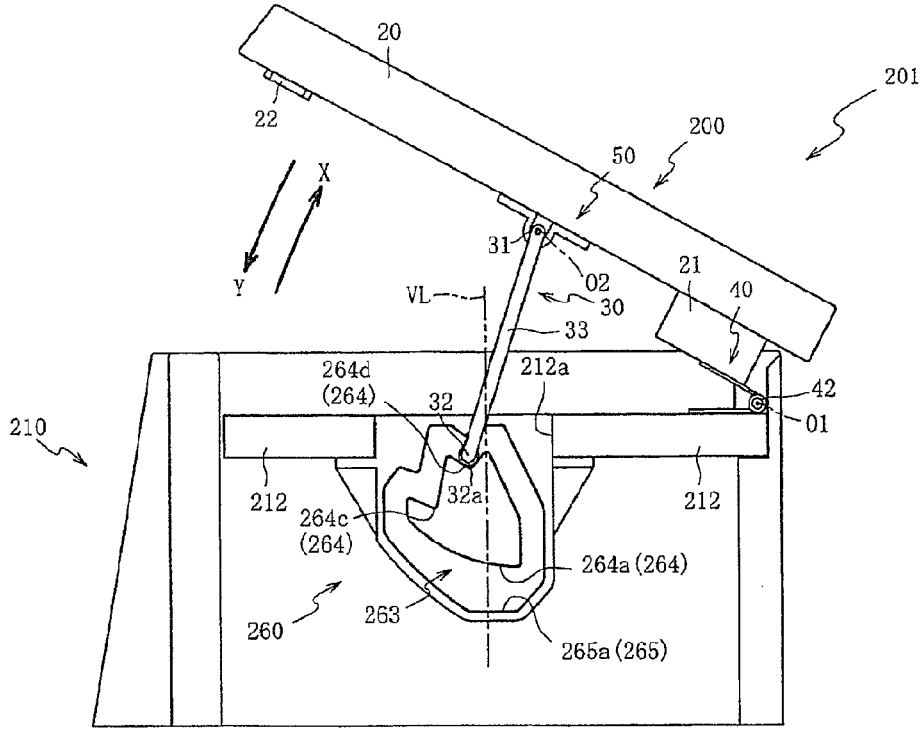
Figure 13:
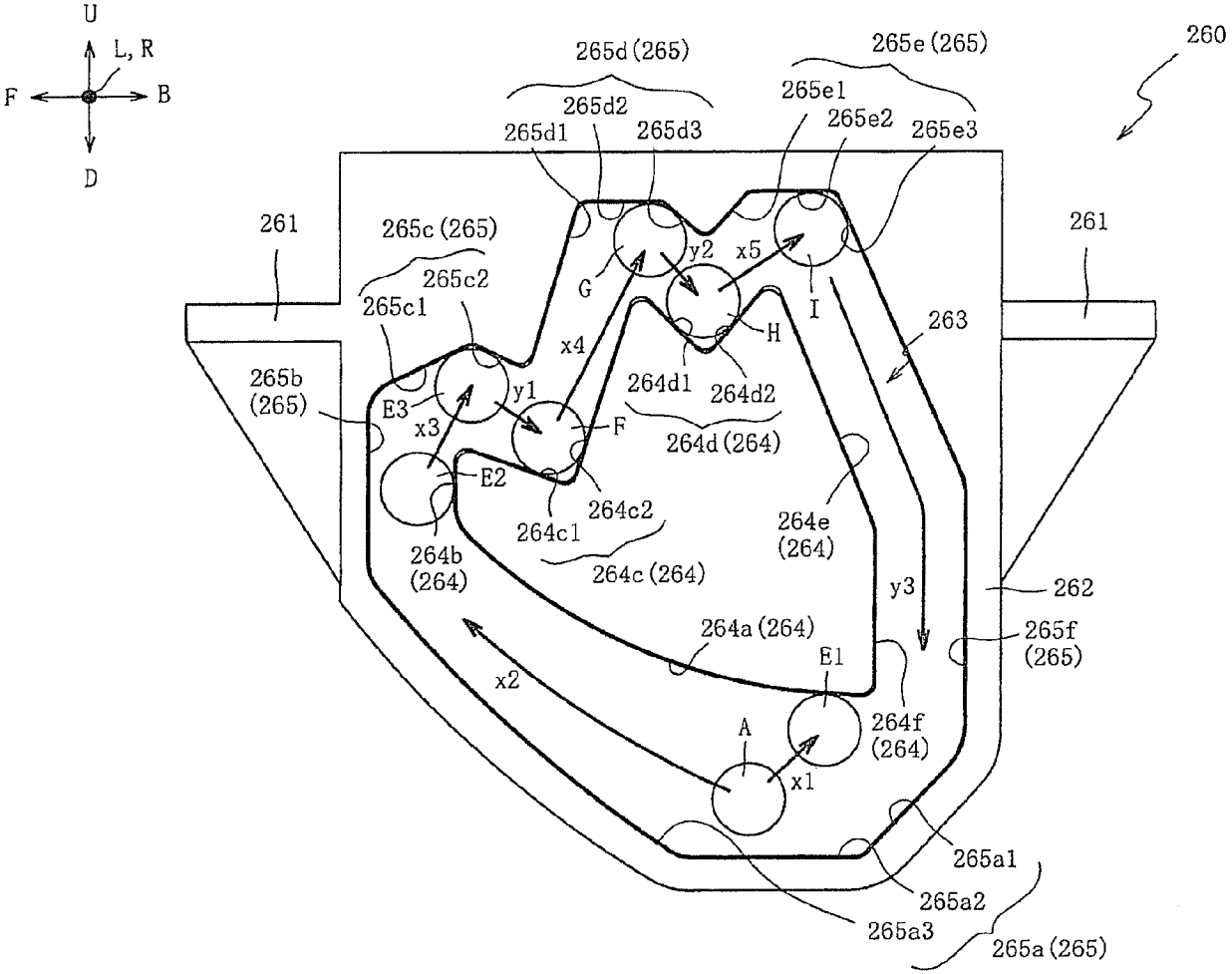
FIG. 13 is a schematic view schematically illustrated a movement aspect of a guided part of a bearing bar guided to a guiding channel.

Next, referring to FIGS. 12A and 12B and FIG. 13, a movement aspect of the guided part 32 of the bearing bar 30 according to a revolving operation of the lid 20 is described. FIG. 12A and FIG. 12B are partial side views of the keyboard instrument 201 in which the lid 20 is up. FIG. 13 is a schematic view of a movement aspect of the guided part 32 of the bearing bar 30 guided to the guiding channel 263. The lid 20 is maintained in the open state through the engagement of the guided part 32 of the bearing bar 30 and the inner peripheral first concave surface 264*c*, as shown in FIG. 12A. The lid 20 is maintained in the open state through the engagement of the guided part 32 and the inner peripheral second concave surface 264*d*, as shown in FIG. 12B. In addition, in order to simplify the drawing and allow easier understanding, the side plate on the right side of the support 11 of the keyboard instrument 201 is not shown in FIG. 12A and FIG. 12B. In addition, positions A, E-I in FIG. 13 schematically shows positions of the guided part 32 of the bearing bar 30 moving according to a revolving operation of the lid 20 respectively.

As shown in FIGS. 12A and 12B and FIG. 13, when the lid 20 is revolved in the X direction from a state in which the lid 20 is down, the guided part 32 of the bearing bar 30 is guided to the guiding channel 263 of the guiding member 260 while moving to the inner peripheral concave surface 264*c* of the inner peripheral wall 264 of the guiding channel 263. Further, the movement of the guided part 32 in the front-back direction and in the downward direction is restrained by the inner peripheral concave surface 264*c*. Thus, the lid 20 can be supported by the bearing bar 30, and the open state of the lid 20 is maintained.

Moreover, when the lid 20 is revolved further in the X direction from the state of being up through the guided part 32 of the bearing bar 30 being engaged with the inner peripheral concave surface 264*c*, the guided part 32 of the bearing bar 30 is guided to the guiding channel 263 of the guiding member 260 while moving to the inner peripheral second concave surface 264*d* of the inner peripheral wall 264, and the movement of the guided part 32 in the front-back direction and downward is restrained by the inner peripheral second concave surface 264*d*. Hereby, the lid 20 can be supported by the bearing bar 30, and the open state of the lid 20 is maintained.

In the former case the lid 20 is opened through the engagement of the guided part 32 of the bearing bar 30 and the inner peripheral second concave surface 264*d*. In comparing the former case with a case that the lid 20 is opened through the engagement of the guided part 32 of the bearing bar 30 and the inner peripheral concave surface 264*c*, the lid 20 of the former case can be opened under a state that the tilt angle between the lid 20 and the musical instrument body 210 of the lid 20 is larger.

Therefore, when the lid 20 is up, the tilt angle between the lid 20 to the musical instrument body 210 of the lid 20 can be selected according to performer's preference. Accordingly, an expansion of sound and a sound quality, etc., generated by a performer of the musical instrument body 210 can be adjusted by selecting the tilt angle between the lid 20 and the musical instrument body 210 of the lid 20.

In addition, when the lid 20 is revolved further in the X direction from the state of being up through the guided part 32 being engaged with the inner peripheral second concave surface 264*d*, the guided part 32 of the bearing bar 30 is guided to the guiding channel 263 of the guiding member 260 while moving between the first incline surface 264*a* of the inner peripheral wall 264 and the outer peripheral first concave surface 265*a* of the outer peripheral wall 265 of the guiding channel 263, and the lid 20 being down a close state is achieved through the support abutting part 22 of the lid 20 abuts on the support 11 of the musical instrument body 210.

Specifically, since the shaft supported member 31 of the bearing bar 30 is supported by the lid 20, the guided part 32 of the bearing bar 30 is revolved like a pendulum with the axis 02 of the shaft supported member 31 as a revolving center. The guided part 32 has a tendency to locate on the vertical line VL passing through the axis 02 of the shaft supported member 31 due to gravity. That is, in a close state of the lid 20, the guided part 32 is located on the position A on the vertical line VL passing through the axis 02 of the shaft supported member 31.

When the lid 20 is revolved in the X direction with the axis 01 as a revolving center from a state in which the guided part 32 of the bearing bar 30 is located on the position A, that is, a state in which the lid 20 is down, the shaft supported member 31 of the bearing bar 30 supported by the lid 20 moves in the X direction. At this time, the guided part has a tendency to locate on the vertical line VL passing through the axis 02 of the shaft supported member 31 due to gravity. Therefore, the guided part 32 moves along the x1 direction parallel to the X direction according to the movement of the shaft supported member 31, and reaches a position E1.

In a state that the guided part 32 reaches the position E1, which is a state that the guided part 32 abuts on the first incline surface 264*a* of an inner peripheral wall 264, the first incline surface 264*a* inclines upward as it moves forward; therefore, the guided part 32 located on the position E1 is restrained to move backward. Hereby, the guided part 32 slides on the first incline surface 264*a* while being guided to upward and forward (x2 direction) according to the revolution in the X direction of the lid 20, and reaches a position E2.

Besides, the lower end of the first incline surface 264*a* of the inner peripheral wall 264 is located further backward than the position A and the upper end thereof is located further forward than the position A. Therefore, the guided part 32 located on the position A can be certainly abutted on the first incline surface 264*a*.

In a state that the guided part 32 reaches the position E2, which is a state that the guided part 32 abuts on the upper end of the first incline surface 264*a* and the guidance by the first incline surface 264*a* is completed, the restraining for the backward movement of the guided part 32 by the first incline surface 264*a* is aborted. At this time, the guided part 32 is located further forward than the shaft supported member 31. Therefore, when the guided part 32 passes over the upper end of the first incline surface 264*a*, the guided part 32 slides on the second incline surface 264*b* while being guided upward and backward (x3 direction), and reaches a position E3.

In a state that the guided part 32 reaches the position E3, which a state in that the guided part 32 abuts on the outer peripheral second upward facing inclined concave surface 265*c*1 inclining upward as it moves backward and the outer peripheral second downward facing inclined concave surface 265*c*2 inclining downward as it moves backward of the outer peripheral second concave surface 265*c* of the outer peripheral wall 265, the movement in the x3 direction of the guided part 32 is restrained. At this time, the guided part 32 is engaged with the outer peripheral second upward facing inclined concave surface 265*c*1 and the outer peripheral second downward facing inclined concave surface 265*c*2. Therefore, the movement in the X direction of the lid 20 is restrained. In this case, the lid 20 is revolved continuously in the Y direction.

Besides, in a state that the guided part 32 reaches the position E3, the guided part 32 of the bearing bar 30 is located further forward than the vertical line VL passing through the axis 02 of the shaft supported member 31 in a state that the lid 20 is down. In contrast, the shaft supported member 31 is located further backward than the vertical line VL passing through the axis 02 of the shaft supported member 31 in a state that the lid 20 is down. Therefore, by revolving the lid 20 in the Y direction, the shaft supported member 31 of the bearing bar 30 moves downward and forward. In contrast, the guided part 32 has a tendency to locate on the vertical line VL of the shaft supported member 31 and has a tendency to move downward and backward (y1 direction). As a result, the guided part 32 moves in the y1 direction from the position E3 and reaches a position F.

In a state that the guided part 32 reaches the position F, which is a state that the guided part 32 abuts on the inner peripheral first downward facing inclined concave surface 264*c*1 and the inner peripheral first upward facing inclined concave surface 2 264*c*2 of the inner peripheral concave surface 264*c* of the inner peripheral wall 264, the guided part 32 is engaged with the inner peripheral first downward facing inclined concave surface 264*c*1 and the inner peripheral first upward facing inclined concave surface 264*c*2. Therefore, the movement in the front-back direction and downward of the guided part 32 is restrained. Hereby, the movement of the lid 20 in the Y direction is restrained; therefore, the lid 20 can be supported by the bearing bar 30. And then the lid 20 is maintained opened by stopping the revolving operation of the lid 20.

When the lid 20 is revolved further in the X direction from the state that the guided part 32 of the bearing bar 30 is located on the position F, which is the state that the guided part 32 is engaged with the inner peripheral concave surface 264*c*, the guided part 32 slides on the inner peripheral first upward facing inclined concave surface 264*c*2 of the inner peripheral concave surface 264*c* while being guided upward and backward (x4 direction), and reaches a position G. Herein, the guided part 32 is disengaged from the inner peripheral concave surface 264*c*.

When the guided part 32 reaches the position G, the guided part 32 abuts on the later mentioned concave surfaces of the outer peripheral third concave surface 265*d* of the outer peripheral wall 265, i.e. the outer peripheral third horizontal concave surface 265*d*2 and the outer peripheral third downward facing inclined concave surface 265*d*3. The outer peripheral third horizontal concave surface 265*d*2 horizontally extends in the front-back direction. The outer peripheral third downward facing inclined concave surface 265*d*3 inclines downward as it extends backward. The movement of the guided part 32 in the x4 direction is restrained. At this time, the guided part 32 is engaged with the outer peripheral third horizontal concave surface 265*d*2 and the outer peripheral third downward facing inclined concave surface 265*d*3; therefore, the movement in the X direction of the lid 20 is restrained. In this case, the lid 20 is continuously revolved in the Y direction.

Besides, in a state that the guided part 32 reaches the position G, the guided part 32 of the bearing bar 30 is located further forward than the vertical line VL passing through the axis 02 of the shaft supported member 31 that the lid 20 is down. In contrast, the shaft supported member 31 is located further backward than the vertical line VL passing through the axis 02 of the shaft supported member 31 in a state that the lid 20 is down. Therefore, by revolving the lid 20 in the Y direction, the shaft supported member 31 of the bearing bar 30 moves downward and forward; in contrast, the guided part 32 on which the force attempting to locate on the vertical line of the shaft supported member 31 acts moves downward and backward (y2 direction). As a result, the guided part 32 moves in the y2 direction from the position G, and reaches a position H.

Under the situation that the guided part 32 reaches the position H, which is the guided part 32 abuts on the inner peripheral second downward facing inclined concave surface 264*d*1 and the inner peripheral second upward facing inclined concave surface 264*d*2 of the inner peripheral second concave surface 264*d* of the inner peripheral wall 264, the guided part 32 is engaged with the inner peripheral second downward facing inclined concave surface 264*d*1 and the inner peripheral second upward facing inclined concave surface 264*d*2. Therefore, the movement of the guided part 32 in the front-back direction and in the downward direction is restrained. Hereby, the movement of the lid 20 in the Y direction is restrained. Therefore, the lid 20 can be supported by the bearing bar 30 and the state in which the lid 20 is opened can be maintained by finishing the revolving operation of the lid 20 in this state.

Thus, by the revolving operation of the lid 20, without operating the bearing bar 30, the lid 20 can be adjusted from a close state to an open state and the tilt angle with respect to the musical instrument body 210 of the lid 20 can be changed. Therefore, the operations for adjusting the lid 20 from the close state to the open state and adjusting the tilt angle to the musical instrument body 210 of the lid 20 can be simplified.

Moreover, by revolving the lid 20 in the X direction and revolving the lid 20 in the Y direction after the revolution of the lid 20 in the X direction is restrained, the lid 20 can be changed from a close state to an open state and the tilt angle with respect to the musical instrument body 210 of the lid 20 can be changed. Therefore, the complicated revolving operation of the lid 20 for engaging the guided part 32 of the bearing bar 30 with the inner peripheral concave surface 264*c* and the inner peripheral second concave surface 264*d* can be unnecessary. Therefore, the operability of adjusting the lid 20 to an up state and adjusting the tilt angle with respect to the musical instrument body 210 of the lid 20 can be improved.

In addition, under the situation that the lid 20 is up, which is a situation that the guided part 32 of the bearing bar 30 is engaged with the inner peripheral concave surface 264*c* and the inner peripheral second concave surface 264*d*, the guided part 32 is located further forward than the vertical line VL passing through the shaft supported member 31 under a situation that the lid 20 is closed. In contrast, the shaft supported member 31 is located further backward than the vertical line VL passing through the shaft supported member 31 under the situation that the lid 20 is down. Accordingly, the guided part 32 of the bearing bar 30 is engaged with the inner peripheral concave surface 264*c* or the inner peripheral second concave surface 264*d* in front of the shaft supported member 31. Therefore, the lid 20 can be supported by the bearing bar 30 under a situation that a line connecting the shaft supported member 31 and the guided part 32 (axis direction of the connecting part 33) is arranged along the Y direction, which the direction for laying down the lid 20. Accordingly, the lid 20 can be stably supported by the bearing bar 30.

When the lid 20 is revolved further in the X direction from the state that the guided part 32 of the bearing bar 30 reaches the position H, which is the guided part 32 being engaged with the inner peripheral second concave surface 264*d*, the guided part 32 slides on the inner peripheral second upward facing inclined concave surface 264*d*2 of the inner peripheral second concave surface 264*d* while being guided upward and backward (x5 direction), and reaches a position I. Hereby, t the guided part 32 is disengaged from the inner peripheral second concave surface 264*d*.

Under the situation that the guided part 32 reaches the position I, which is a state that the guided part 32 abuts on the later mentioned concave surfaces of the outer peripheral fourth concave surface 265*e* of the outer peripheral wall 265, i.e. the outer peripheral fourth horizontal concave surface 265*e*2 and the outer peripheral fourth downward facing inclined concave surface 265*e*3, wherein the outer peripheral fourth horizontal concave surface 265*e*2 horizontally extends in the front-back direction and the outer peripheral fourth downward facing inclined concave surface 265*e*3 inclines downward as it moves backward, the movement of the guided part 32 in the x5 direction is restrained. At this time, the guided part 32 is engaged with the outer peripheral fourth horizontal concave surface 265*e*2 and the outer peripheral fourth downward facing inclined concave surface 265*e*3; therefore, the revolution in the X direction of the lid 20 is restrained. In this case, the lid 20 is continuously revolved in the Y direction.

Hereby, the guided part 32 is guided to the y3 direction by the second incline surface 264*e* and the inner peripheral second vertical surface 264*f* of the inner peripheral wall 264, and the outer peripheral fourth downward facing inclined concave surface 265*e*3 and the outer peripheral second vertical surface 265*f* of the outer peripheral wall 265 while moving between the first incline surface 264*a* of the inner peripheral wall 264 and the outer peripheral first concave surface 265*a* of the outer peripheral wall 265, and reaches the position A. As a result, the support abutting part 22 of the lid 20 abuts on the upper part of the support 11, and the lid 20 is completely down.

Thus, by performing only the revolving operation of the lid 20, without operating the bearing bar 30, the lid 20 can be adjusted from an open state to a close state. Therefore, the operation for adjusting the lid 20 from an open state to a close state can be simplified.

In addition, by revolving the lid 20 further in the X direction from the open state, and revolving the lid 20 in the Y direction after the revolution of the lid 20 in the X direction is restrained, the lid 20 can be in a close state. Therefore, the complicated revolving operation of the lid 20 can be obviated, and the operability of adjusting the lid 20 to a close state can be improved.

As described above, by performing only the revolving operation of the lid 20, without operating the bearing bar 30, the lid 20 can be adjusted to an open state or a close state and the tilt angle with respect to the musical instrument body 210 of the lid 20 can be changed; therefore, the operations for adjusting the lid 20 to a open state or a close state and adjusting the tilt angle with respect to the musical instrument body 210 of the lid 20 can be simplified.

Figure 14:
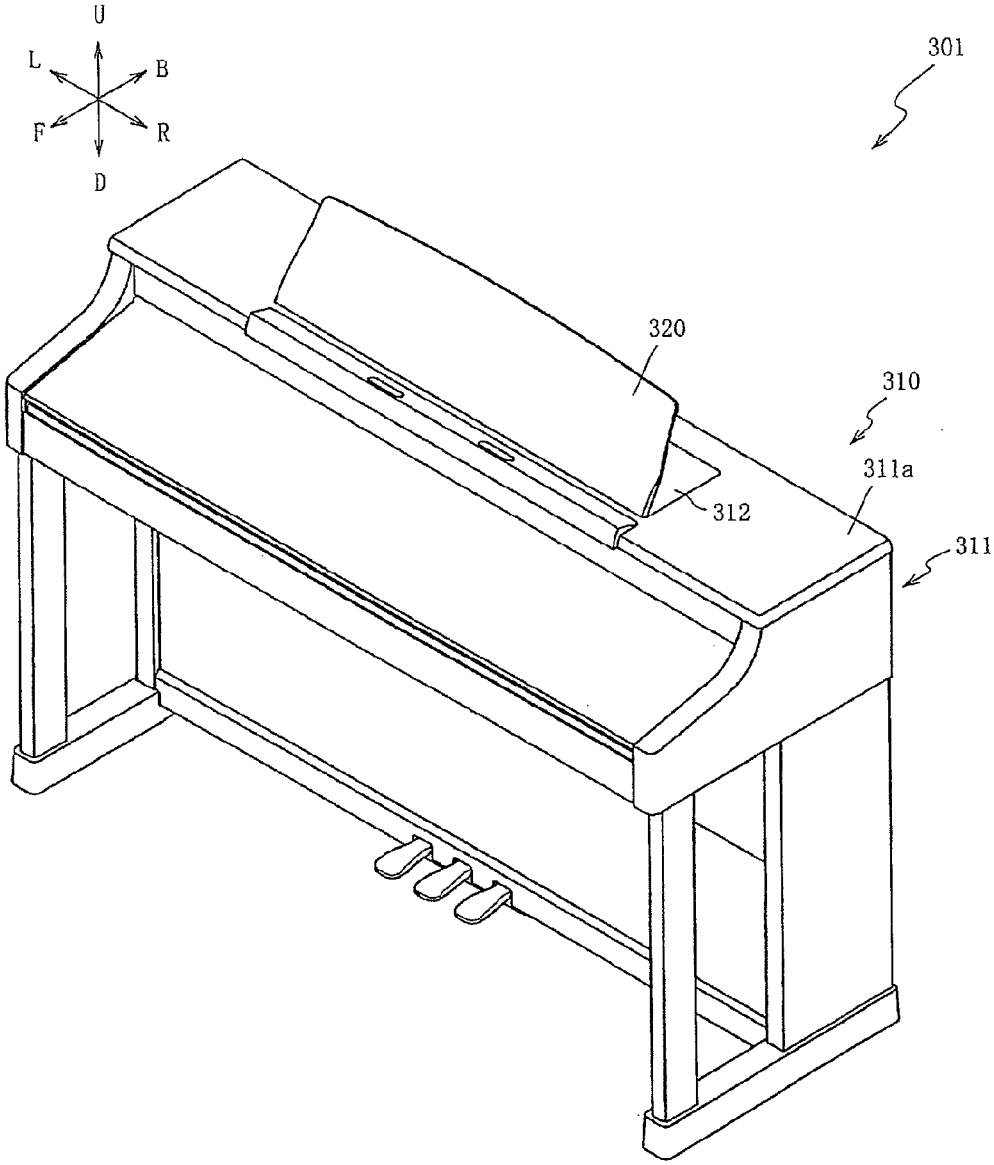
FIG. 14 is a perspective view of a keyboard instrument according to a third embodiment of the invention.
Figure 15:
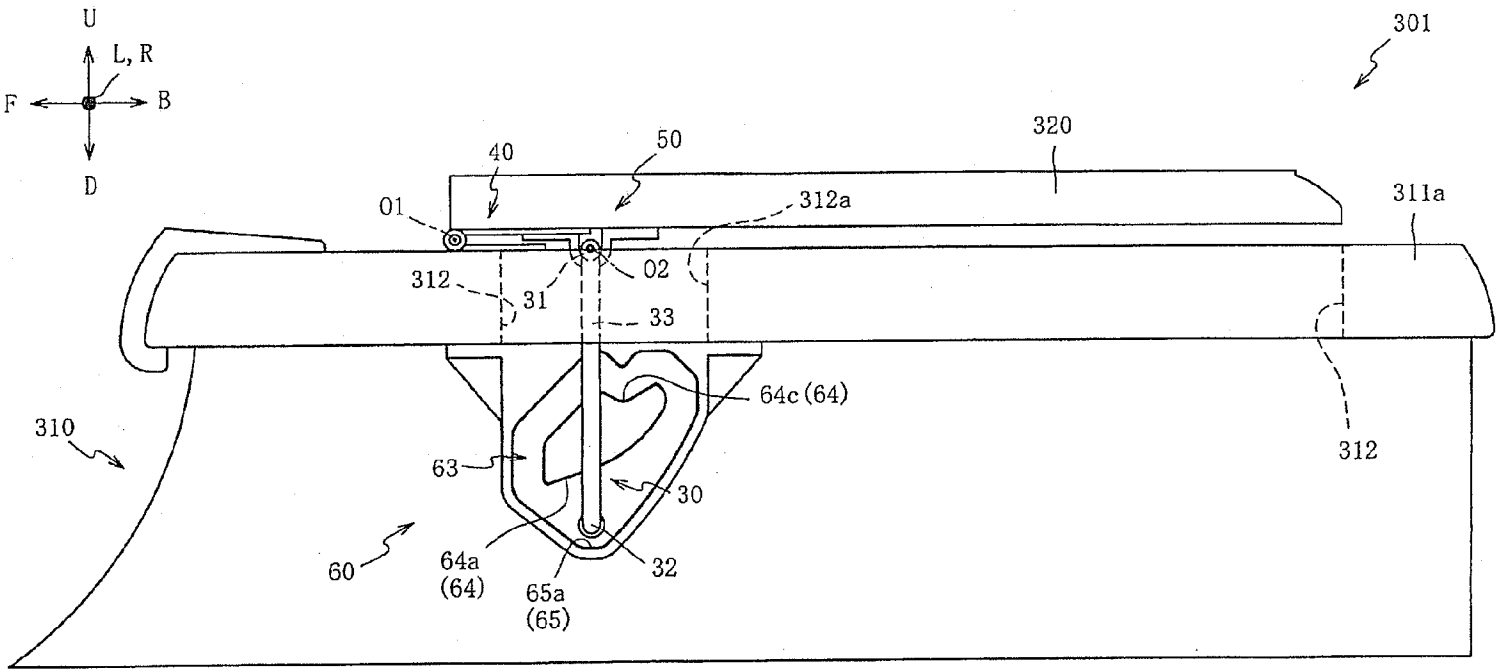
FIG. 15 is a partial side view of the keyboard instrument in a state in which a music stand is closed.
Figure 16:
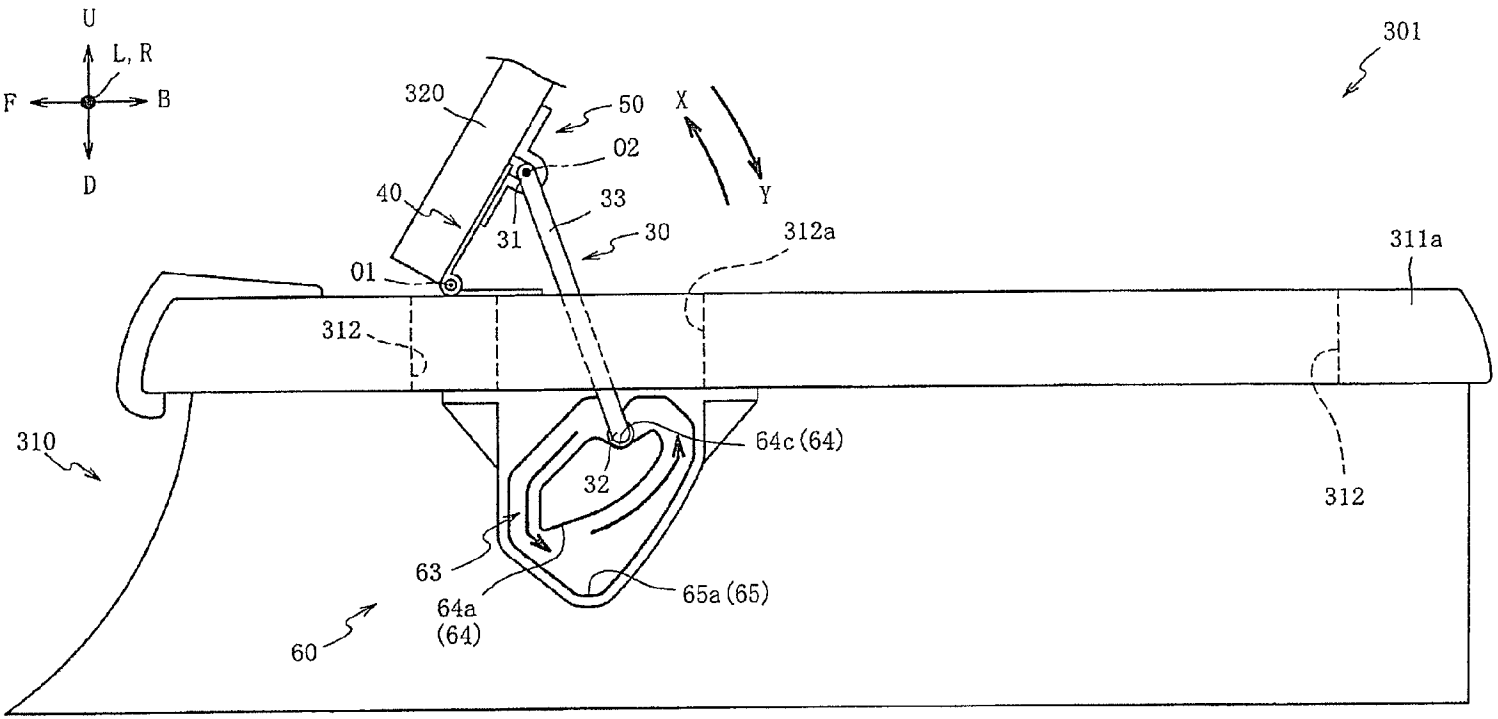
FIG. 16 is a partial side view of the keyboard instrument in a state in which the music stand is opened.

Next, referring to FIG. 14-FIG. 16, a third embodiment is described. In the first embodiment, a case of applying the present invention to the lid 20 of the keyboard instrument 1 is described. However, in the third embodiment, a case of applying the present invention to a music stand 320 of a keyboard instrument 301 is described. Besides, the same reference numbers are used to refer the same or like parts in this exemplary embodiment and the above-mentioned first embodiment, and explanation thereof is omitted herein.

First, referring to FIG. 14, a configuration of the keyboard instrument 301 according to the third embodiment of the invention is described. FIG. 14 is a perspective view of the keyboard instrument 301 according to the third embodiment of the invention.

The keyboard instrument 301 is a piano which has a plurality of white keys and black keys to be depressed by a performer, and is mainly configured with a musical instrument body 310 generating sounds by a performer, the music stand 320 mounted on an upper part of the musical instrument body 310 in a rotatable manner, and the bearing bar 30 supporting the music stand 320 with respect to the musical instrument body 310 under a situation that the music stand 320 is opened (see FIG. 16). In addition, the musical instrument body 310 includes a support 311 having a top board 311*a* in a plate shape in which a center part is opened along a left-right direction, and a blocking member 312 in a plate shape blocking the opening of the top board 311*a* of the support 311, wherein the music stand 320 is rotatably mounted to the blocking member 312.

The blocking member 312 is a member in a plate-shaped member, wherein a notch 312*a* which is inwardly recessed at the left and/or right side surfaces of the blocking member 312 (see FIG. 15), is formed in a front part of the blocking member 312 along the front-back direction. The music stand 320 is a member for putting music score on when a performer plays the keyboard instrument 301, and has a plate shape.

Next, referring to FIG. 15 and FIG. 16, a configuration of the keyboard instrument 301 with the music stand 320 mounted thereon is described. FIG. 15 is a partial side view of the keyboard instrument 301 with the music stand 320 down. FIG. 16 is a partial side view of the keyboard instrument 301 with the music stand 320 up. Besides, in FIG. 15 and FIG. 16, in order to simplify the drawing and allow easier understanding, a state in which a side plate on the right side of the support 311 of the keyboard instrument 301 is removed is schematically shown, and the blocking member 312 and a part of the bearing bar 30 which is inserted into the inside of the notch 312*a* of the blocking member 312 are shown by a dashed line.

As shown in FIG. 15 and FIG. 16, when the music stand 320 is revolved in the X direction from the state that the music stand 320 is down, the guided part 32 of the bearing bar 30 is guided to the guiding channel 63 of the guiding member 60 while moving to the inner peripheral concave surface 64*c* of the inner peripheral wall 64 of the guiding channel 63. Further, by restraining the movement of the guided part 32 in the front-back direction by the inner peripheral concave surface 64*c*, the music stand 320 is supported by the bearing bar 30 and the music stand 320 is maintained opened.

In addition, when the music stand 320 is revolved further in the X direction from the state of being down, the guided part 32 of the bearing bar 30 is guided to the guiding channel 63 of the guiding member 60 while moving between the first incline surface 64*a* of the inner peripheral wall 64 and the outer peripheral first concave surface 65*a* of the outer peripheral wall 65 of the guiding channel 63, and the music stand 320 goes into a close state.

Thus, by performing only the revolving operation of the music stand 320, without operating the bearing bar 30, the music stand 320 can be adjusted from an open state to a close state; therefore, the operation for adjusting the music stand 320 from an open state to a close state can be simplified.

Herein, in the first embodiment, the hinge 40 is mounted on a back side of the lid 20 and is supported on the blocking member 12 in a rotatable manner rotating with respect to the axis 01, which is located on the back side of the lid 20, as a revolving center. In contrast, the hinge 40 is mounted on a front side of the music stand 320 and is supported on the blocking member 312 in a rotatable manner rotating with respect the axis 01 on which the music stand 320 is located on the front side as a revolving center in the third embodiment. A orientation direction of the guiding channel 63 of the guiding member 60 in a front-back direction is determined according to a position of the axis 01 as a revolving center of the lid 20 or of the music stand 320. Therefore, the guiding member 60 in the third embodiment and the guiding member 60 in the first embodiment are mounted on the blocking member 12, 312 respectively such that the shapes of the guiding channel 63 of the first embodiment and the third embodiment reverse with each other in the front-back direction.

Accordingly, the guided part 32 of the bearing bar 30 is guided in a clockwise direction by the guiding channel 63 of the guiding member 60 mounted on the right side of the blocking member 12 between the guiding member 60 mounted on the right and the left of the keyboard instrument 1 in the first embodiment. In contrast, the guided part 32 of the bearing bar 30 is guided in a counter clockwise direction by the guiding channel 63 of the guiding member 60 mounted on the right side of the blocking member 312 between the guiding member 60 mounted on the right and the left in the third embodiment.

In addition, the guiding member 60 in the third embodiment is mounted on the position at the blocking member 312 that is closer to the axis 01 than that of the position on the blocking member 12 of the guiding member 60 in the first embodiment. Hereby, the tilt angle with respect to the musical instrument body 310 of the music stand 320 in the third embodiment is larger than the tilt angle with respect to the musical instrument body 10 of the lid 20 in the first embodiment.

That is to say, even if the shapes of the bearing bar 30 and the guiding member 60 are the same, the tilt angles with respect to the musical instrument bodies 10 and 310 of the lid 20 and the music stand 320 can be adjusted by adjusting the separation distance to the axis 01 of the guiding member 60. Accordingly, adjusting the shape of the guiding channel 63 recessed on the guiding member 60 and the size in an axis direction of the connecting part 33 of the bearing bar 30 can be unnecessary; therefore, the versatility of the guiding member 60 can be improved.

The present invention having been thus described with respect to the embodiments; however, the present invention should not be limited to the embodiments described above. It will be apparent that various changes and modifications may be practiced without departing from the spirit of the invention.

For example, in each of the embodiments described above, the coating member 32*a* being coated only on the guided part 32 of the bearing bar 30 is described. The invention, however, is not limited to the coating member 32*a* being coated on the entire bearing bar 30. Since the weight of the entire bearing bar 30 can be increased, the gravity acting on the guided part 32 can be effectively used for that.

In each of the embodiments described above, the bearing bar 30 is formed in a squared U-shape. The invention, however, is not limited to the bearing being formed in a Z-shape or an F-shape, and the axial supported part formed on one end of the bearing bar and the guided part formed the other end of the bearing bar having only to be disposed in a direction in which those axis directions are parallel to each other.

In addition, in each of the embodiments described above, the bearing bar 30 is composed of a metallic material and is formed by bending the end part of the rod-shaped member. The invention, however, is not limited to the bearing bar 30 being composed of a resin material and formed by joining two or more members by bonding or welding, etc.

In each of the embodiments described above, the inner peripheral concave surface 264*c* and the inner peripheral second concave surface 264*d* are located on a side further away from the axis 01 than the vertical line VL passing through the axis 01 of the shaft supported member 31 of the bearing bar 30 under the condition that the lid 20 and the music stand 320 are closed. However, the invention is not limited to the above configuration of the inner peripheral concave surface. At least under the situation that the guided part 32 of the bearing bar 30 is engaged with the inner peripheral concave surface 64*c*, the inner peripheral concave surface 264*c* or the inner peripheral second concave surface 264*d*, the inner peripheral concave surface 64*c*, the inner peripheral concave surface 264*c* and the inner peripheral second concave surface 264*d* locate on a side further away from the axis 01 than the vertical line VL passing through the axis 02 of the shaft supported member 31 of the bearing bar 30. When the guided part 32 by the inner peripheral concave surface 64*c*, the inner peripheral concave surface 264*c* and the inner peripheral second concave surface 264*d* are disengaged, the guided part 32 can be moved to a side close to the axis 01. Further, when the lid 20 or the music stand 320 is supported by the bearing bar 30, the lid 20 or the music stand 320 can be supported by the bearing bar 30 under the condition that a line connecting the shaft supported member 31 and the guided part 32 (axis direction of the connecting part 33) is arranged along a direction for laying down the lid 20 or the music stand 320; therefore, the lid 20 or the music stand 320 can be stably supported by the bearing bar 30.

In each of the embodiments described above, the lid 20 or the music stand 320 is supported on the blocking members 12, 212, 312 in a rotatable manner through the lid 20 or the music stand 320 being connected with the blocking members 12, 212, 312 by the hinge 40; however, the invention is not limited as such. Instead of the hinge 40, any members which can support the lid 20 or the music stand 320 in a rotatable manner with respect to the blocking members 12, 212, 312 can be used.

In each of the embodiments described above, the notches 12*a*, 212*a*, 312*a* for inserting the connecting part 33 of the bearing bar 30 are formed on the left or right sides of the blocking members 12, 212, 312. However, the invention is not limited to the above blocking members. A loop-shaped hole such a ring shape or a squared shape can be configured in the blocking members 12, 212, 312 along the plate thickness direction of the blocking members, and the connecting part 33 of the bearing bar 30 can be inserted into the hole.

In each of the embodiments described above, the guiding member 60 is mounted on the lower surface sides of the blocking members 12, 212, 312 and the guided part 32 of the bearing bar 30 is guided by the guiding channel 63 recessed on the guiding member 60. But the invention is not limited as such. A guiding channel can be formed on a support of a musical instrument.

In the second embodiment described above, the tilt angle with respect to the musical instrument body 210 of the lid 200 that is up in an open state is set as two levels through the inner peripheral wall 264 of the guiding member 260 comprising the inner peripheral concave surface 264*c* and the inner peripheral second concave surface 264*d*. However, the invention is not limited as such. Instead, three or more inner peripheral concave surfaces recessed downward can be provided and each of the inner peripheral concave surfaces can be disposed on a position along the front-back direction. Hereby, the tilt angle with respect to the musical instrument body 210 of the lid 200 in the open state can be set as more than three levels.

In the third embodiment, on a lower surface side (back surface side) of the top board 311*a* of the support 311, a plate-shaped member can be provided at a position that faces one side surface of the guiding member 60 having the guiding channel 63 recessed in the guiding member 60. Further, the movement of bearing bar 30 along the left-right direction can be restrained by the plate-shaped member. Accordingly, the guided part 32 can be prevented from moving outwardly further than the inner peripheral wall 64 and the outer peripheral wall 65 of the guiding channel 63 along the left-right direction. Thus the movement of the guided part 32 due to the guiding of the guiding channel 63 can be maintained. Besides, a separation distance between the plate-shaped member and the one surface side of the guiding member 60 is set to be larger than the size in the axis direction of the guided part 32.

In addition, in the third embodiment, the music instrument body 310 includes the plate-shaped blocking member 312 for blocking the opening of the plate-shaped top board 311*a* which is being opened at the center part the support 311 in the left-right direction, and the music stand 320 is rotatably mounted to the blocking member 312. However, the invention is not limited to the above music instrument body. A hole, into which the bearing bar 30 can be inserted, can be provided on a center part of the top board in the left-right direction. Further, in a state that the connecting part 33 of the bearing bar 30 is inserted into the hole, the invention may also provide that the music stand 320 be rotatably mounted on the top board, wherein the shaft supported member 31 of the bearing bar 30 is inserted into the shaft-supporting member 50 and the guided part 32 is guided by the guiding member 60.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A musical instrument, comprising:

a musical instrument body;

a revolving board in a plate shape supported on the musical instrument body in a rotatable manner rotating about a first axis and is switched between a close state and an open state;

a bearing bar, wherein an end of the bearing bar is supported on the revolving board in a rotatable manner rotating about a second axis; and a guiding member having a loop-shaped guiding channel for guiding an other end of the bearing bar, wherein the guiding channel comprises an inner peripheral wall forming an inner peripheral of the guiding channel, the inner peripheral wall comprises:

a guiding inclined plane, located above the other end of the bearing bar in a case which the other end of the bearing bar is located on a vertical line passing through the second axis when the revolving board is down in the close state and is inclined upward while the other end of the bearing bar moving away from the first axis; and a first concave surface, located above the guiding inclined plane, and recessed downward, and the revolving board maintains the open state by engaging the other end of the bearing bar with the first concave surface.

2. The musical instrument as claimed in claim 1, wherein the other end of the bearing bar is engaged with the first concave surface at a position which is further away from the first axis than the vertical line passing through the second axis when the revolving board is in the open state.

3. The musical instrument as claimed in claim 1, wherein the guiding channel comprises an outer peripheral wall forming an outer peripheral of the guiding channel and opposite to the inner peripheral wall, wherein the other end of the bearing bar is away from the outer peripheral wall when the other end of the bearing bar is located on the vertical line passing through the second axis when the revolving board is in the close state.

4. The musical instrument as claimed in claim 1, wherein the outer peripheral wall comprises a second concave surface, the second concave surface is located above the first concave surface and on a side closer to the first axis than an upper end of the guiding inclined plane and on a side further away from the first axis than the first concave surface, and recesses upward.

5. The musical instrument as claimed in claim 1, wherein the outer peripheral wall comprises a third concave surface, the third concave surface is located above the first concave surface and on a side closer to the first axis than the first concave surface, and recesses upward.

6. The musical instrument as claimed in claim 5, wherein the third concave surface is located in a range from the first concave surface toward a side closer to the first axis in a distance of two times of an outer diameter of the bearing bar.

7. The musical instrument as claimed in claim 5, wherein the third concave surface restrains a revolving of the revolving board by engaging the other end of the bearing bar when the revolving board is revolved at most five degrees from the open state in a direction of further opening the revolving board.

8. The musical instrument as claimed in claim 1, wherein the bearing bar is formed in a U-shape by bending an end and an other end of a rod-shaped member.

9. The musical instrument as claimed in claim 1, wherein the bearing bar is composed of a metallic material.

10. The musical instrument as claimed in claim 9, wherein the bearing bar comprises a coating member made of a resin for coating an outer peripheral surface of the other end of the bearing bar.

11. The musical instrument as claimed in claim 1, wherein the musical instrument body comprises a support having an opening, and a blocking member in a plate shape blocking the opening of the support and detachably mounted on the support, wherein the revolving board is rotatably supported on a side of the blocking member and the guiding member is mounted on an other side of the blocking member.

12. The musical instrument as claimed in claim 11, wherein the blocking member comprises a notch recessed inward with respect to an axis direction of the second axis, the bearing bar is formed in a U-shape comprising a support shaft and an end leg and an other end leg, wherein the one end leg and the other end leg of the bearing bar are parallel to each other and parallel to an axis direction of the first axis, and the support shaft between the end leg and the other end leg is inserted into the notch of the blocking member, and the end leg of the support shaft is supported on the revolving board, the guiding member is mounted on the blocking member at a position where upward extensions of the inner peripheral wall and the outer peripheral wall of the guiding channel are parallel to an axis direction of the other end leg of the bearing bar, and the other end of the bearing bar is guided to the guiding channel.

13. The musical instrument as claimed in claim 12, wherein when the blocking member is mounted on the support, a separation distance L1 exists between an end on a side of the guiding channel of the guiding member where the bearing bar is disposed and the support facing the end, and a length L2 along the axis direction of the other end of the bearing bar is set to be larger than the separation distance L1.

14. The musical instrument as claimed in claim 1, wherein the inner peripheral wall comprises a fourth concave surface located on a side closer to the first axis than the first concave surface, and recesses downward.

* * * * *